US011063348B2

(12) United States Patent
Tanabe et al.

(10) Patent No.: US 11,063,348 B2
(45) Date of Patent: Jul. 13, 2021

(54) RADOME AND PATTERN FORMING METHOD

(71) Applicant: NEC CORPORATION, Tokyo (JP)

(72) Inventors: Kosuke Tanabe, Tokyo (JP); Masashi Hirabe, Tokyo (JP)

(73) Assignee: NEC CORPORATION, Tokyo (JP)

( * ) Notice: Subject to any disclaimer, the term of this patent is extended or adjusted under 35 U.S.C. 154(b) by 0 days.

(21) Appl. No.: 16/495,429

(22) PCT Filed: Feb. 6, 2018

(86) PCT No.: PCT/JP2018/003911
§ 371 (c)(1),
(2) Date: Sep. 19, 2019

(87) PCT Pub. No.: WO2018/173518
PCT Pub. Date: Sep. 27, 2018

(65) Prior Publication Data
US 2020/0076069 A1 Mar. 5, 2020

(30) Foreign Application Priority Data
Mar. 22, 2017 (JP) ..... JP2017-056088

(51) Int. Cl.
*H01Q 1/42* (2006.01)

(52) U.S. Cl.
CPC ..... *H01Q 1/422* (2013.01)

(58) Field of Classification Search
CPC .. H01Q 1/42–428; H01Q 15/02; H01Q 15/08; H01Q 15/23; H01Q 19/021; H01Q 19/06; H01Q 19/065; H01Q 19/067; H01Q 19/12
See application file for complete search history.

(56) References Cited

U.S. PATENT DOCUMENTS 118,196 A * 8/1871 Clark ..... H01Q 1/42 343/700
214,988 A * 5/1879 Bramble ..... H01Q 1/422
239,577 A * 3/1881 Turner ..... H01Q 1/42 343/872
248,902 A * 11/1881 Whitman ..... H01Q 1/42 343/872
285,604 A * 9/1883 Finn et al. ..... H01Q 1/42 343/872
346,177 A * 7/1886 Southack ..... H01Q 1/42
6,169,524 B1 * 1/2001 Wu ..... H01Q 15/02 343/910
2004/0239577 A1 12/2004 Delgado et al.

FOREIGN PATENT DOCUMENTS

JP 2002-033611 A 1/2002
JP 033611 A * 1/2002 ..... H01Q 3/02

OTHER PUBLICATIONS

International Search Report for PCT/JP2018/003911, dated May 1, 2018.

* cited by examiner

*Primary Examiner* — Andrea Lindgren Baltzell
(74) *Attorney, Agent, or Firm* — Sughrue Mion, PLLC

(57) ABSTRACT

A radome (20) includes a first region (20A) and a second region (20B) having different radio-wave transmission characteristics from each other, and is configured to form a null pattern in substantially a front direction of an antenna by superimposing a first radio wave that has passed through the first region (20A) and a second radio wave that has passed through the second region (20B).

10 Claims, 28 Drawing Sheets

RADOME AND PATTERN FORMING METHOD

This application is a National Stage of International Application No. PCT/JP2018/003911 filed Feb. 6, 2018, claiming priority based on Japanese Patent Application No. 2017-056088 filed Mar. 22, 2017, the disclosure of which is incorporated herein in its entirety by reference.

TECHNICAL FIELD

The present disclosure relates to a radome and a pattern forming method.

BACKGROUND ART

In order to install a radio system for mobile backhaul, the direction of a transmission-side antenna is adjusted while the reception level detected by a reception-side antenna is being checked so as to orient a radio beam of the transmission-side antenna to the reception-side antenna (for example, Patent Literature 1). For example, the installer adjusts the azimuth direction and the elevation direction of the transmission-side antenna by measuring, with a voltmeter, the reception level obtained by converting a radio reception signal of the reception-side antenna into voltage so that the measured value is to be maximum.

CITATION LIST

Patent Literature

Patent Literature 1: Japanese Unexamined Patent Application Publication No. 2002-033611

SUMMARY OF INVENTION

Technical Problem

Recently, in radio communication, the capacity has been increased and the distance has been lengthened. Then, as the capacity of radio communication is increased, frequencies to be used have been heightened, and the diameters of antennas have been increased to lengthen the distance. For example, the communication using frequencies in 60 GHz, 70/80 GHz, and over 100 GHz bands has been required.

However, if a frequency to be used is heightened and the diameter of an antenna is increased, the radio beam of a transmission-side antenna becomes narrow. For example, when the frequency to be used is in the 70/80 GHz band and the diameter is 60 cm, the beam width (that is, the angle width with which the power is halved) is narrow, such as about 0.5°.

When the beam width is narrow, it is extremely difficult to detect the main lobe of the radio beam with a reception-side antenna, and it takes time to adjust the direction of the transmission-side antenna, and which can deteriorate the efficiency of the work for installing a radio system.

A purpose of the present disclosure is to provide a radome and a pattern forming method that enable the direction of a transmission-side antenna to be easily adjusted.

Solution to Problem

A radome according to a first aspect of the present disclosure is a radome arranged to face an antenna and configured to transmit a radiation radio wave of the antenna, the radome includes a first region and a second region having different radio-wave transmission characteristics from each other, in which the radome is configured to form a null pattern in substantially a front direction of the antenna by superimposing a first radio wave that has passed through the first region and a second radio wave that has passed through the second region.

A pattern forming method according to a second aspect of the present disclosure uses a radome arranged to face an antenna, configured to transmit a radiation radio wave of the antenna, and comprising a first region and a second region having different radio-wave transmission characteristics from each other, and includes superimposing a first radio wave that has passed through the first region and a second radio wave that has passed through the second region to form a null pattern in substantially a front direction of the antenna.

Advantageous Effects of Invention

According to the present disclosure, it is possible to provide a radome and pattern forming method that enable the direction of a transmission-side antenna to be easily adjusted.

DESCRIPTION OF EMBODIMENTS

Hereinafter, example embodiments are described with reference to the drawings. In the example embodiments, the same or equivalent elements are denoted by the same reference signs, and duplicated descriptions are omitted.

First Example Embodiment

<Configuration Example of Antenna Device>

Figure 1:
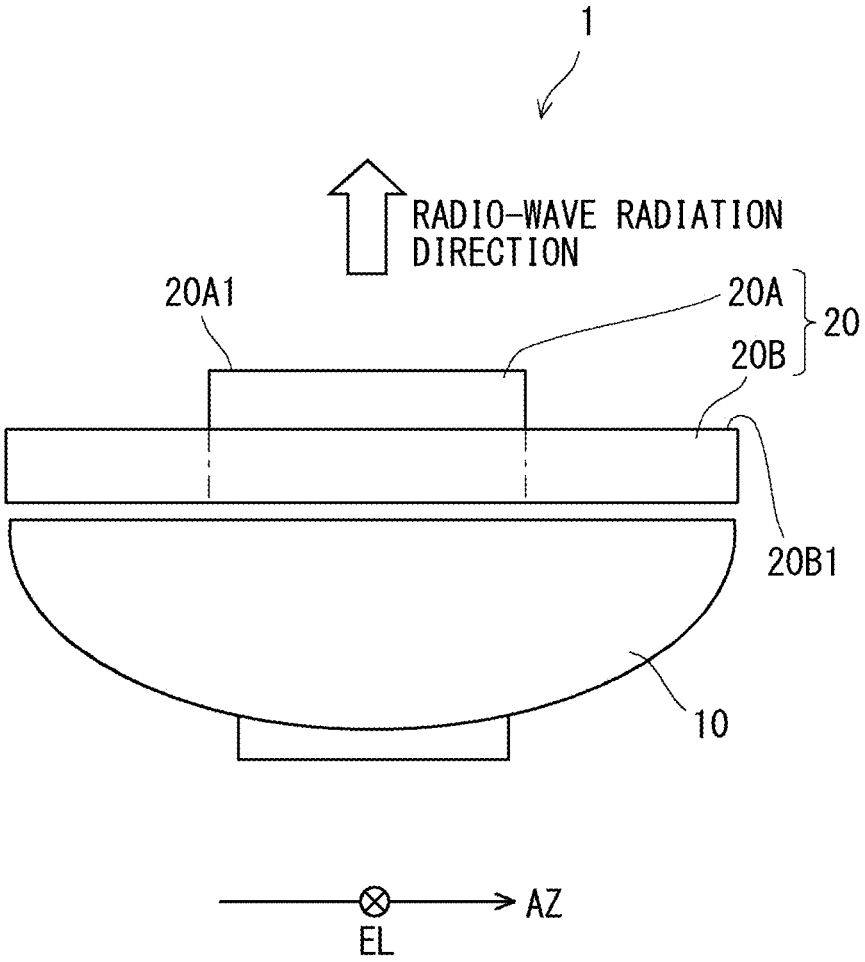
FIG. 1 is a diagram showing an example of an antenna device in a first example embodiment.
Figure 2:
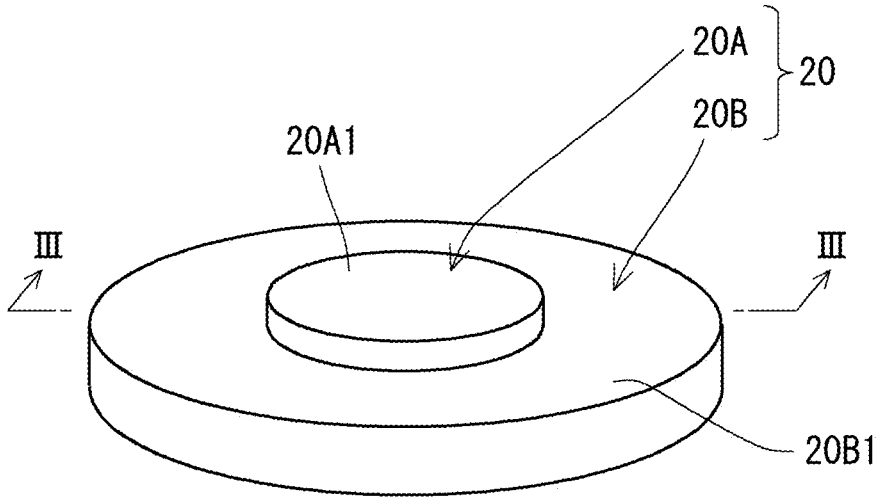
FIG. 2 is a perspective view showing an example of a radome in the first example embodiment.
Figure 3:
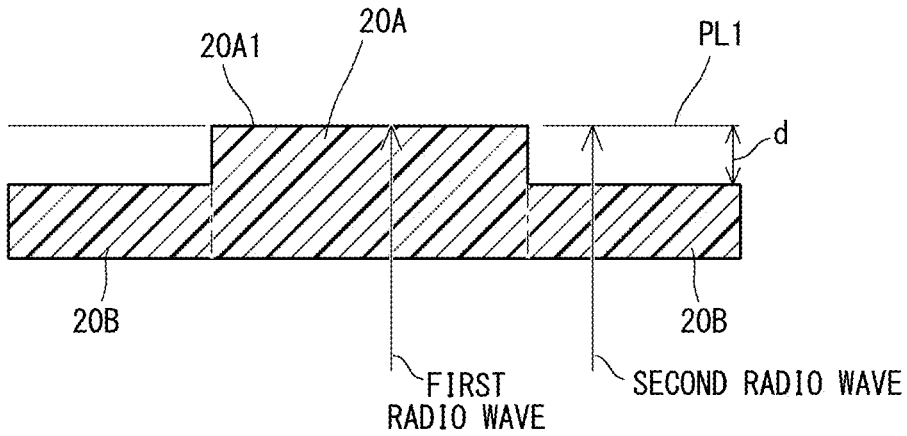
FIG. 3 is a cross-sectional view taken in the direction of the arrows III-III in FIG. 2.

FIG. 1 is a diagram showing an example of an antenna device in a first example embodiment. FIG. 2 is a perspective view showing an example of a radome in the first example embodiment. FIG. 3 is a cross-sectional view taken in the direction of the arrows III-III in FIG. 2.

An antenna device 1 is configured to be rotatable about the rotation axes in an azimuth-angle-adjustment rotation axis direction AZ (hereinafter, simply referred to as an "azimuth-axis direction") and in an elevation-angle-adjustment rotation axis direction EL (hereinafter, simply referred to as an "elevation-axis direction") shown in FIG. 1. Thus, it is possible to mechanically adjust the radio-wave radiation direction of the antenna device 1.

In FIG. 1, the antenna device 1 includes an antenna main body 10 and a radome (a pattern forming device, a pattern forming member) 20. FIG. 1 illustrates that the antenna main body 10 is a parabolic antenna, but the antenna main body 10 is not limited thereto and may be, for example, a planar antenna. Hereinafter, the antenna main body 10 can be simply referred to as an "antenna".

The antenna main body 10 radiates a radio wave in the front direction of the antenna (the radio-wave radiation direction in FIG. 1). The radio wave radiated from the antenna main body 10 has a narrow width of the main lobe (that is, a narrow beam width) as to be described later.

The radome 20 is arranged on the front side of the antenna main body 10 to face the antenna main body 10. The radome 20 transmits a radiation radio wave of the antenna main body 10. The transmitted radiation radio wave travels toward the target position of a reception-side antenna (not shown) when the direction of the antenna device 1 has been adjusted. In the following, the direction in which the antenna main body 10 faces the radome 20 can be referred to as a "facing direction", and the "facing direction", the "front direction", and the "radio-wave radiation direction" are substantially aligned.

The radome 20 includes a first region 20A and a second region 20B having different "radio-wave transmission characteristics" from each other. The radome 20 is configured to form a null pattern in substantially the front direction of the antenna by superimposing a "first radio wave" that has passed through the first region 20A and a "second radio wave" that has passed through the second region 20B.

For example, the radome 20 has a plate shape, and a circular shape in plane view (that is, when viewed from the front side of the antenna) in the first example embodiment. The first region 20A is a circular region including the center of the circle in plane view, and the second region 20B is a doughnut-shaped region surrounding the circular region. That is, the arrangement pattern of the first region 20A and the second region 20B in plane view has line symmetry with respect to the diameter of the radome 20 and has rotational symmetry with respect to the center of the circle.

In addition, the first region 20A and the second region 20B are formed of the same material (for example, resin), but have different thicknesses from each other in the facing direction in the first example embodiment. Specifically, the first region 20A is thicker than the second region 20B by the difference d as shown in FIG. 3. That is, a step is formed at the boundary between the first region 20A and the second region 20B. The difference d is set so that a first phase of the first radio wave in a front side face 20A1 of the first region 20A is to be the opposite phase to a second phase of the second radio wave in a plane PL1 including the front side face 20A1 of the first region 20A. That is, the following expression (1) holds.

$$d|1/\lambda a-1/\lambda 0|=(2n-1)*0.5 \quad (n\text{: natural number}) \tag{1}$$

Here, $\lambda a$ is the wavelength of the radio wave according to the material of the radome 20 and traveling in the radome 20, and $\lambda 0$ is the wavelength of the radio wave traveling in the air.

A first area of the front side face 20A1 of the first region 20A and a second area of a front side face 20B1 of the second region 20B are set so that the absolute value of the integration of the magnetic field that has passed through the front side face 20A1 (that is, the total sum of the magnetic field vectors) is to be equal to the absolute value of the integration of the magnetic field that has passed through the front side face 20B1.

As described above, the first radio wave and the second radio wave have the opposite phases to each other by passing through the radome 20 and the same absolute value of the integration, and cancel each other. As the result of this, a null pattern is formed in substantially the front direction of the antenna.

<Description of Formation Pattern>

Figure 4:
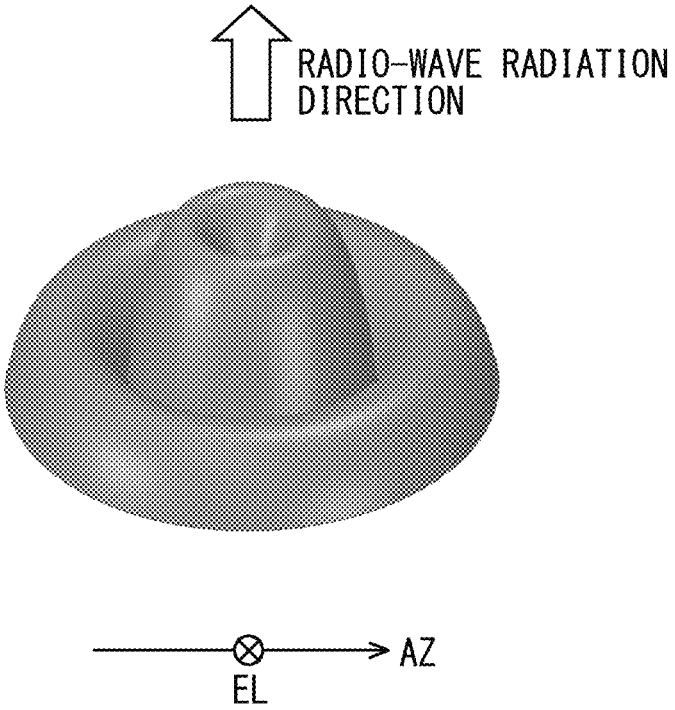
FIG. 4 is a diagram schematically showing a formation pattern in the first example embodiment.
Figure 5:
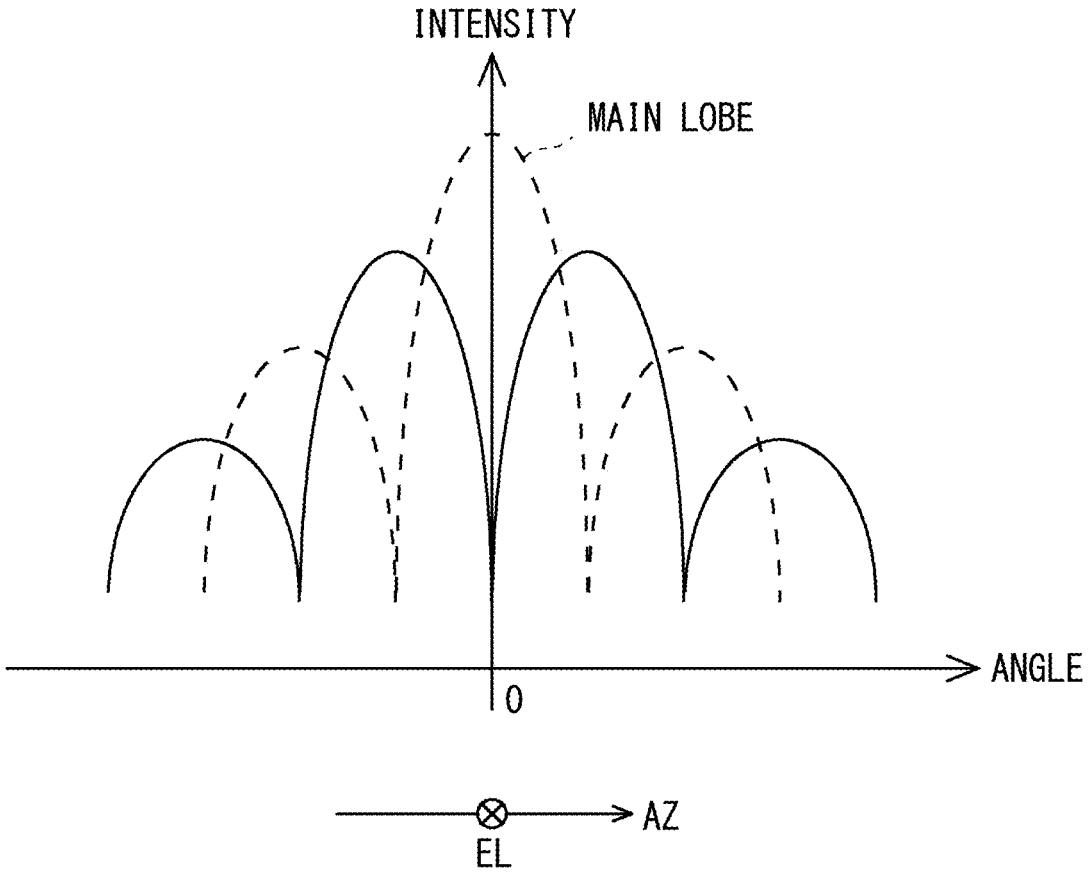
FIG. 5 is a diagram for explaining the formation pattern in the first example embodiment.

A directivity pattern of a radio wave radiated from the antenna device 1 having the above configuration, that is, a formation pattern formed by the antenna device 1 is described below. FIG. 4 is a diagram schematically showing a formation pattern in the first example embodiment. FIG. 5 is a diagram for explaining the formation pattern in the first example embodiment. FIG. 5 particularly shows, in the formation pattern shown in FIG. 4, the pattern (solid line) in the plane orthogonal to the elevation-axis direction. FIG. 5 further shows the directivity pattern (dotted line) of a radio wave radiated from the antenna main body 10.

As shown in FIG. 5, the directivity pattern of the radio wave radiated from the antenna main body 10, that is, the directivity pattern of the radio wave to enter the radome 20 has the peak of the main lobe in the front direction of the antenna. As described above, if the width of the main lobe becomes narrow, it is difficult to search for the peak of the main lobe using the reception-side antenna.

On the other hand, as shown in FIG. 4, the formation pattern of the radio wave radiated from the antenna device 1, that is, the directivity pattern of the radio wave that has passed through the radome 20 has a null pattern in substantially the front direction of the antenna, and has a mortar shape. In other words, the formation pattern of the radio wave radiated from the antenna device 1 has a shape obtained by rotating the pattern (solid line) shown in FIG. 5 about the intensity (antenna gain) axis by 360°.

In this formation pattern of the radio wave, the high-intensity portion (that is, high antenna gain portion) is shifted from the front direction in the concentric direction by a predetermined angle. For this reason, the high-intensity portion appears in a wide angle, and it is possible to easily search for the high-intensity portion using the reception-side antenna. In addition, the inclination becomes steep in the vicinity of the front direction of the formation pattern of the radio wave (that is, in the vicinity of the angle zero), which means that the intensity greatly changes with a minute angle. That is, the sensitivity in the vicinity of the front direction of the formation pattern of the radio wave is high. For this reason, it is possible to easily search for the null portion of the formation pattern using the reception-side antenna. As described above, since the formation pattern of the radio wave radiated from the antenna device 1 has "the characteristic that the high-intensity portion appears in a wide angle" and "the characteristic that the sensitivity in the vicinity of the front direction is high", it is possible to easily adjust the antenna direction when the antenna device 1 is used, for example, in a radio system and to improve the efficiency of the work for installing the radio system as a result.

As described above, according to the first example embodiment, the radome (the pattern forming device, the pattern forming member) 20 includes the first region 20A and the second region 20B having different radio-wave transmission characteristics from each other, and is configured to form a null pattern in substantially the front direction of the antenna by superimposing the first radio wave that has passed through the first region 20A and the second radio wave that has passed through the second region 20B.

With the configuration of the radome 20, it is possible to form a directivity pattern having "the characteristic that the high-intensity portion appears in a wide angle" and "the characteristic that the sensitivity in the vicinity of the front direction is high", and it is possible to easily adjust the antenna direction and to improve the efficiency of the work for installing the radio system as a result.

<Modified Example>

The radome 20 in the first example embodiment may be modified as follows.

<1> The radome 20 has been described on the assumption of being formed of one material, but is not limited thereto. The first region 20A and the second region 20B may be formed of different materials from each other.

Figure 6:
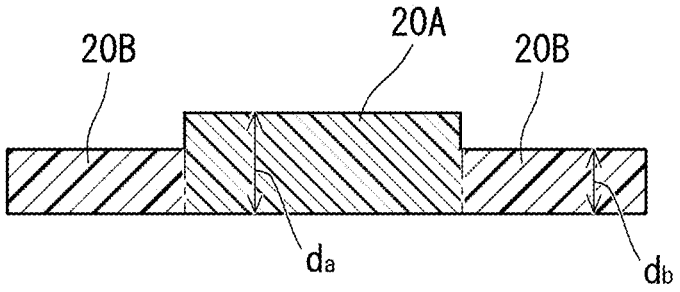
FIG. 6 is a diagram for explaining a radome of a modified example <1> in the first example embodiment.

FIG. 6 is a diagram for explaining a radome of the modified example <1> in the first example embodiment. As shown in FIG. 6, when the thickness of the first region 20A is represented by da, the thickness of the second region 20B is represented by db, the wavelength of the radio wave traveling in the first region 20A is represented by λa, and the wavelength of the radio wave traveling in the second region 20B is represented by λb, the following expression (2) holds in the radome 20 in the modified example <1>.

$$|d_a/\lambda_a-(d_b/\lambda_b+(d_a-d_b)/\lambda_0)|=(2n-1)*0.5 \quad (n\text{: natural number}) \tag{2}$$

With this configuration of the radome 20, it is possible to obtain an effect equivalent to the above. Note that, it is obvious that the thickness da of the first region 20A can be equal to the thickness db of the second region 20B depending on the materials of the first region 20A and the second region 20B.

Figure 7:
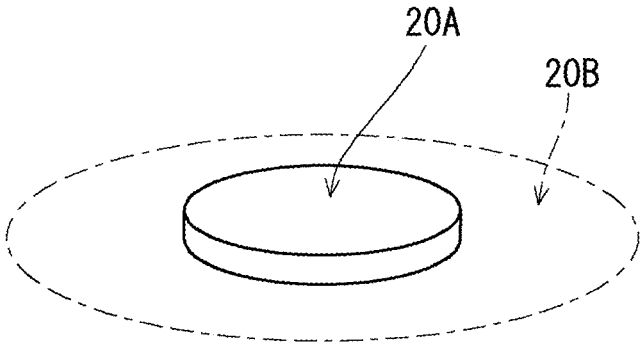
FIG. 7 is a diagram for explaining a radome of a modified example <2> in the first example embodiment.

<2> In addition, as shown in FIG. 7, the radome 20 may include the second region 20B as an air layer. That is, the radome 20 may be a disc (corresponding to the first region 20A) smaller than the radiation region of the radio wave of the antenna main body 10 (that is, the opening region of the reflector when the antenna main body 10 is a parabolic antenna). With the configuration of the radome 20, it is possible to obtain an effect equivalent to the above. FIG. 7 is a diagram for explaining a radome of the modified example <2> in the first example embodiment.

Figure 8:
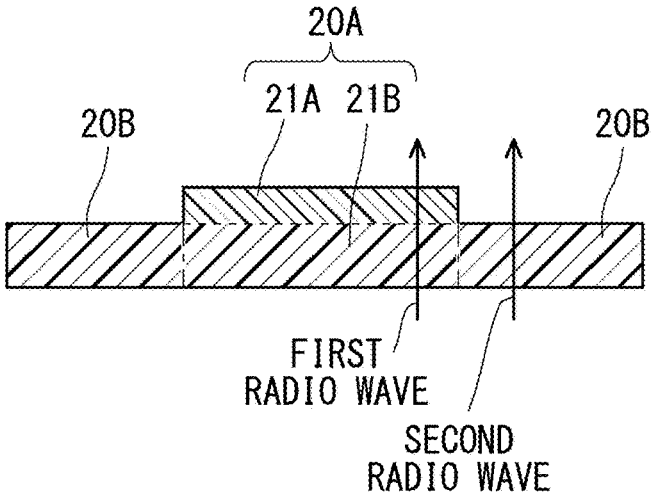
FIG. 8 is a diagram for explaining a radome of a modified example <3> in the first example embodiment.

<3> Furthermore, the first region 20A and the second region 20B may have different layer structures from each other as shown in FIG. 8. In FIG. 8, the first region 20A includes a first layer 21A and a second layer 21B formed of different materials from each other. That is, the first region 20A has a double-layer structure. On the other hand, the second region 20B has a single-layer structure. The second layer 21B and the second region 20B are formed of the same material. That is, the radome 20 shown in FIG. 8 has a structure in which a second disc including the first layer 21A and having a radius smaller than a first disc is stacked on the first disc including the second layer 21B and the second region 20B.

In the configuration of the radome 20, since the first layer 21A and the air layer contribute the phase difference between the first radio wave and the second radio wave, and the above expression (1) holds. Thus, with the configuration of the radome 20, it is possible to obtain an effect equivalent to the above. FIG. 8 is a diagram for explaining a radome of the modified example <3> in the first example embodiment.

Second Example Embodiment

A second example embodiment relates to a radome in which a first region is thinner than a second region in contrast to the first example embodiment. Note that, the basic configuration of an antenna device in the second example embodiment is the same as the antenna device 1 in the first example embodiment, and is described with reference to FIG. 1.

Figure 9:
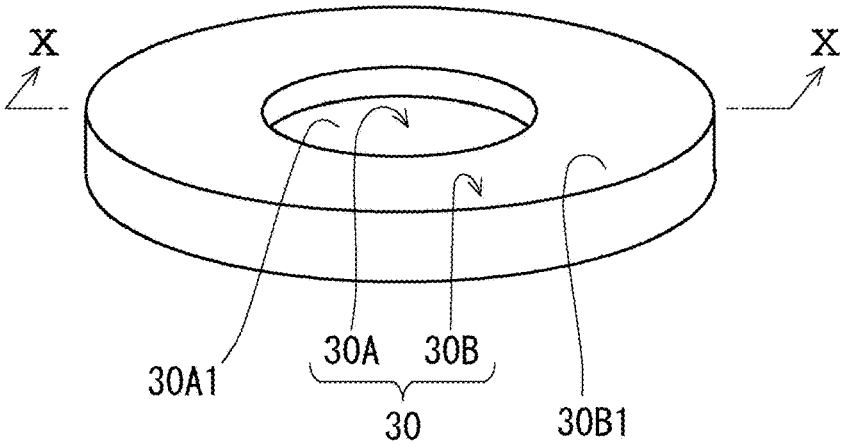
FIG. 9 is a perspective view showing an example of a radome in a second example embodiment.
Figure 10:
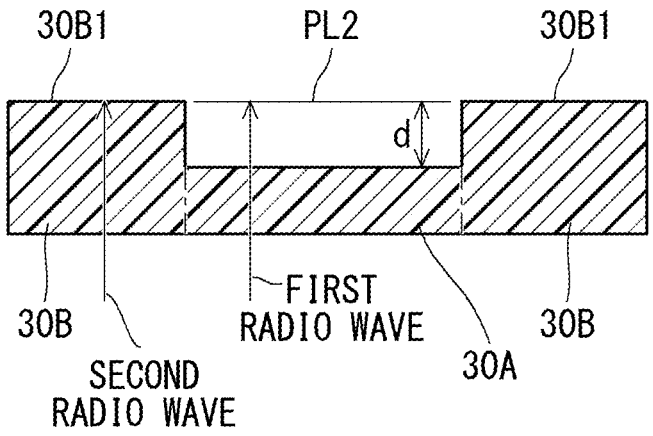
FIG. 10 is a cross-sectional view taken in the direction of the arrows X-X in FIG. 9.

FIG. 9 is a perspective view showing an example of a radome in the second example embodiment. FIG. 10 is a cross-sectional view taken in the direction of the arrows X-X in FIG. 9.

A radome 30 in the second example embodiment is arranged on the front side of an antenna main body 10 to face the antenna main body 10 similarly to the radome 20 in the first example embodiment. The radome 30 transmits a radiation radio wave of the antenna main body 10.

The radome 30 includes, similarly to the radome 20 in the first example embodiment, a first region 30A and a second region 30B having different "radio-wave transmission characteristics" from each other. In addition, similarly to the radome 20 in the first example embodiment, the radome 30 has a plate shape, and a circular shape in plane view. The first region 30A is a circular region including the center of the circle in plane view, and the second region 30B is a doughnut-shaped region surrounding the circle region. The first region 30A and the second region 30B are formed of the same material (for example, resin), but have different thicknesses from each other in the facing direction.

On the other hand, the radome 30 is different from the radome 20 in the first example embodiment in that the second region 30B is thicker than the first region 30A by the difference d. The difference d is set so that a first phase of a first radio wave in a plane PL2 including a front side face 30B1 of the second region 30B shown in FIG. 10 is to be the opposite phase to a second phase of a second radio wave in the front side face 30B1 of the second region 30B shown in FIG. 10. That is, the above expression (1) holds in the second example embodiment.

In addition, similarly to the radome 20 in the first example embodiment, a first area of a front side face 30A1 of the first region 30A and a second area of the front side face 30B1 of the second region 30B are set so that the absolute value of the integration of the magnetic field that has passed through the front side face 30A1 (that is, the total sum of the magnetic field vectors) is to be equal to the absolute value of the integration of the magnetic field that has passed through the front side face 30B1.

In the configuration of the radome 30 in the second example embodiment, similarly to the first example embodiment, the first radio wave and the second radio wave have the opposite phases to each other by passing through the radome 30 and the same absolute value of the integration, and cancel each other. As the result of this, a null pattern is formed in substantially the front direction of the antenna.

Thus, with the configuration of the radome 30, it is possible to form a directivity pattern having "the characteristic that the high-intensity portion appears in a wide angle" and "the characteristic that the sensitivity in the vicinity of the front direction is high", and it is possible to easily adjust the antenna direction and to improve the efficiency of the work for installing the radio system as a result.

<Modified Example>

The radome 30 in the second example embodiment may be modified as follows.

<1> The radome 30 has been described on the assumption of being formed of one material, but is not limited thereto. The first region 30A and the second region 30B may be formed of different materials from each other.

Figure 11:
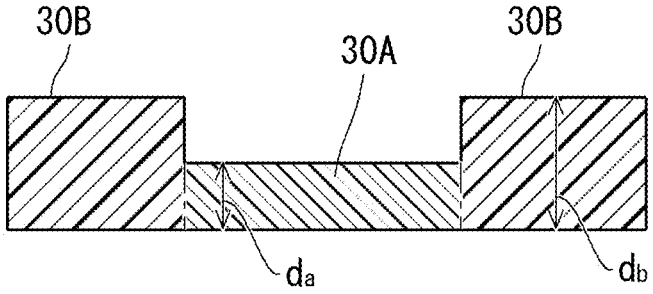
FIG. 11 is a diagram for explaining a radome of a modified example <1> in the second example embodiment.

FIG. 11 is a diagram for explaining a radome of the modified example <1> in the second example embodiment. As shown in FIG. 11, when the thickness of the first region 30A is represented by da, the thickness of the second region 30B is represented by db, the wavelength of the radio wave traveling in the first region 30A is represented by λa, and the wavelength of the radio wave traveling in the second region 30B is represented by λb, the above expression (2) holds in the radome 30 in the modified example <1>.

With the configuration of the radome 30, it is possible to obtain an effect equivalent to the above. Note that, it is obvious that the thickness da of the first region 30A can be equal to the thickness db of the second region 30B depending on the materials of the first region 30A and the second region 30B.

Figure 12:
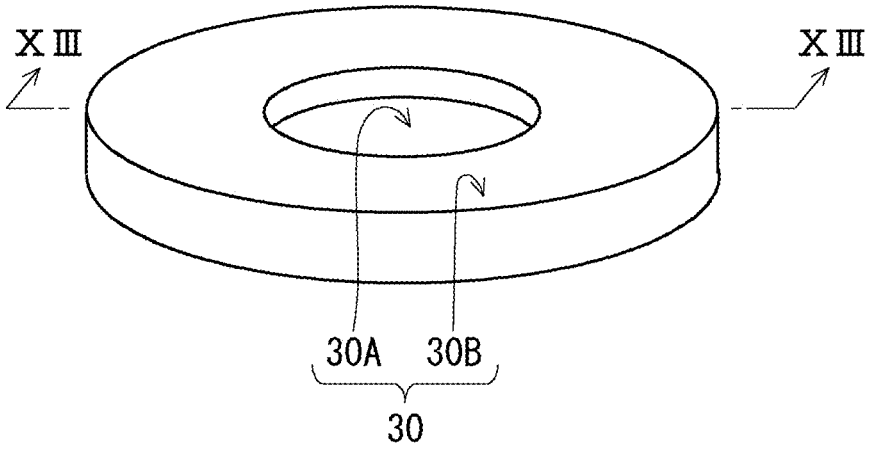
FIG. 12 is a diagram for explaining a radome of a modified example <2> in the second example embodiment.
Figure 13:
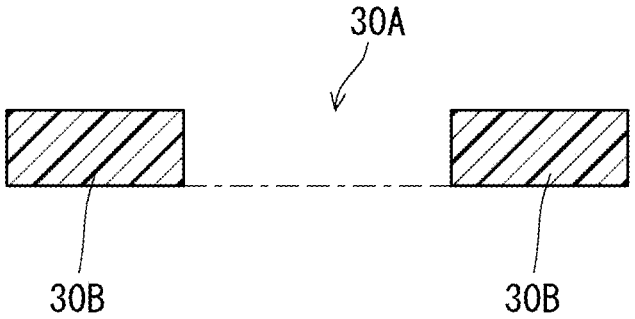
FIG. 13 is a cross-sectional view taken in the direction of the arrows XIII-XIII in FIG. 12.

<2> In addition, as shown in FIGS. 12 and 13, the radome 30 may include the first region 30A as an air layer. That is, the radome 30 may be a doughnut-shaped disc (corresponding to the second region 30B) having a through hole at the position corresponding to the first region 30A. With the configuration of the radome 30, it is possible to obtain an effect equivalent to the above. FIG. 12 is a diagram for explaining a radome of the modified example <2> in the second example embodiment. FIG. 13 is a cross-sectional view taken in the direction of the arrows XIII-XIII in FIG. 12.

Figure 14:
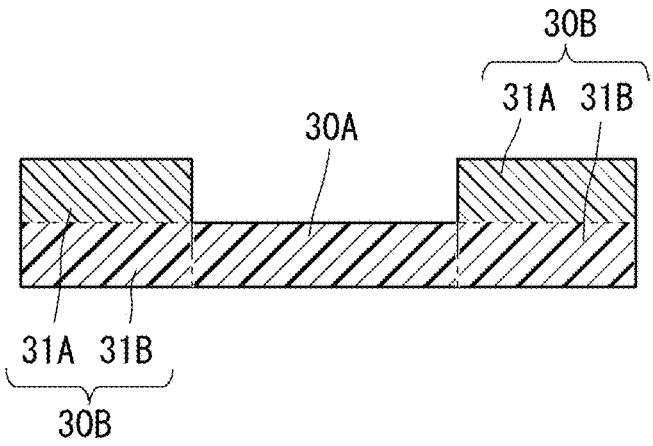
FIG. 14 is a diagram for explaining a radome of a modified example <3> in the second example embodiment.

<3> Furthermore, the first region 30A and the second region 30B may have different layer structures from each other as shown in FIG. 14. In FIG. 14, the first region 30A has a single-layer structure. On the other hand, the second region 30B includes a first layer 31A and a second layer 31B formed of different materials from each other. That is, the second region 30B has a double-layer structure. The first region 30A and the second layer 31B are formed of the same material. That is, the radome 30 shown in FIG. 14 has a structure in which a doughnut-shaped disc including the first layer 31A is stacked on a first disc including the first region 30A and the second layer 31B. FIG. 14 is a diagram for explaining a radome of the modified example <3> in the second example embodiment.

In the configuration of the radome 30, since the first layer 31A and the air layer contribute the phase difference between the first radio wave and the second radio wave, and the above expression (1) holds. Thus, with the configuration of the radome 30, it is possible to obtain an effect equivalent to the above.

Third Example Embodiment

A third example embodiment relates to a radome in which a first region and a second region each have a semicircular shape in plane view. Note that, the basic configuration of an antenna device in the third example embodiment is the same as the antenna device 1 in the first example embodiment, and is described with reference to FIG. 1.

<Configuration Example of Radome>

Figure 15:
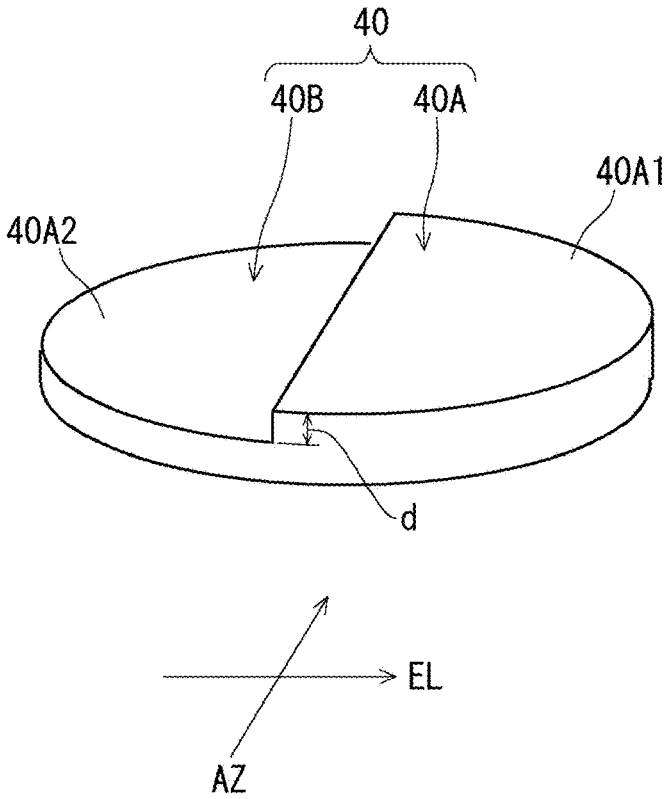
FIG. 15 is a perspective view showing an example of a radome in a third example embodiment.

FIG. 15 is a perspective view showing an example of a radome in the third example embodiment.

A radome 40 in the third example embodiment is arranged on the front side of an antenna main body 10 to face the antenna main body 10 similarly to the radome 20 in the first example embodiment. The radome 40 transmits a radiation radio wave of the antenna main body 10.

The radome 40 includes, similarly to the radome 20 in the first example embodiment, a first region 40A and a second region 40B having different "radio-wave transmission characteristics" from each other. In addition, similarly to the radome 20 in the first example embodiment, the radome 40 has a plate shape, and a circular shape in plane view. The first region 40A and the second region 40B are formed of the same material (for example, resin), but have different thicknesses from each other in the facing direction. Specifically, the first region 40A is thicker than the second region 40B by the difference d as shown in FIG. 15. That is, a step is formed at the boundary between the first region 40A and the second region 40B. The difference d is set so that a first phase of a first radio wave passing through the first region 40A in a front side face 40A1 of the first region 40A is to be the opposite phase to a second phase of a second radio wave passing through the second region 40B in the plane including the front side face 40A1 of the first region 40A. That is, the above expression (1) holds in the third example embodiment.

On the other hand, in the radome 40 in the third example embodiment, the first region 40A and the second region 40B are semicircular regions each having a semicircular shape in plane view. That is, the arrangement pattern of the first region 40A and the second region 40B in plane view has line symmetry with respect to the boundary between the first region 40A and the second region 40B, and has rotational symmetry with respect to the center of the circle of the radome 40.

<Description of Formation Pattern>

Figure 16:
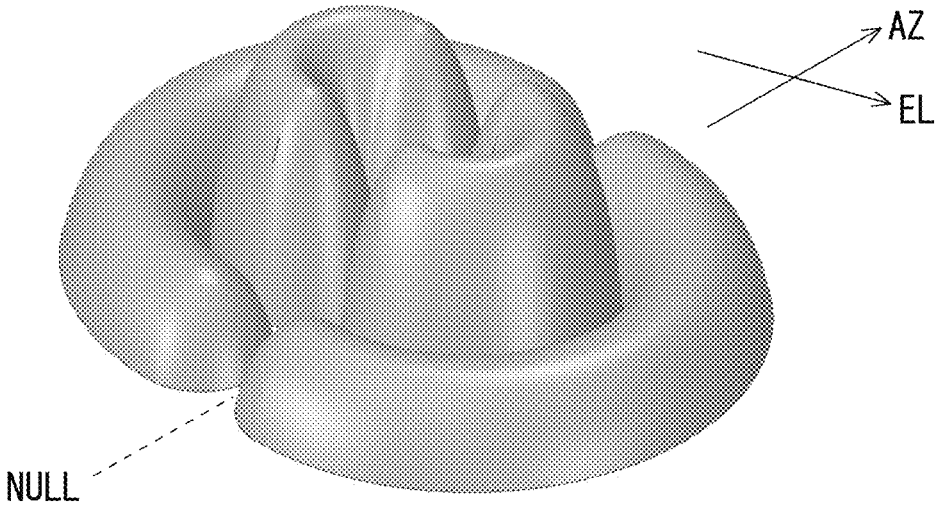
FIG. 16 is a diagram schematically showing a formation pattern in the third example embodiment.

A directivity pattern of a radio wave radiated from an antenna device 1 including the radome 40 having the above configuration, that is, a formation pattern formed by the antenna device 1 is described below. FIG. 16 is a diagram schematically showing a formation pattern in the third example embodiment. Here, the description is made on the assumption that the azimuth-axis direction and the elevation-axis direction have been set as shown in FIGS. 15 and 16, that is, on the assumption that the boundary between the first region 40A and the second region 30B is aligned with the azimuth-axis direction.

As shown in FIG. 16, the formation pattern of the radio wave radiated from the antenna device 1 in the third example embodiment, that is, the directivity pattern of the radio wave that has passed through the radome 40 is different from the directivity pattern in the first example embodiment (FIG. 4) in that a null is formed in the entire azimuth-axis direction. That is, the main lobe and the sidelobe becomes a null in the entire azimuth-axis direction. On the other hand, the pattern obtained by cutting the formation pattern of the radio wave radiated from the antenna device 1 in the third example embodiment in the plane orthogonal to the azimuth-axis direction is the same as the pattern (solid line) shown in FIG. 5 in the first example embodiment. In addition, in the pattern obtained by cutting the formation pattern in the plane orthogonal to the azimuth-axis direction, the phases of the peaks on the left and right sides of the null are inverted.

In such a formation pattern of a radio wave, the main lobe and the sidelobe becomes a null in the entire azimuth-axis direction, and it is possible to more easily search for the null portion of the formation pattern using the reception-side antenna and to easily adjust the azimuth angle of the antenna device 1. In addition, in the pattern obtained by cutting the formation pattern in the plane orthogonal to the azimuth-axis direction, the phases of the peaks on the left and the right sides of the null are inverted, and it is possible to easily adjust the azimuth angle of the antenna device 1 using phase information. Note that, the description has been made on the assumption that the boundary between the first region 40A and the second region 40B is aligned with the azimuth-axis direction, but the boundary is not limited to being aligned with the azimuth-axis direction and may be aligned with the elevation-axis direction.

As described above, according to third example embodiment, the radome 40 has a circular shape in plane view, and the first region 40A and the second region 40B are semicircular regions.

With the configuration of the radome 40, it is possible to form a directivity pattern having a null in the direction of the boundary face between the first region 40A and the second region 40B, and it is possible to more easily search for the null portion of the formation pattern using the reception-side antenna. In addition, the phases on both sides of the boundary between the first region 40A and the second region 40B are inverted, and it is possible to more easily search for the null portion of the formation pattern using the reception-side antenna. For this reason, it is possible to easily adjust the antenna direction and to improve the work for installing the radio system as a result.

<Modified Example>

The radome 40 in the third example embodiment may be modified as follows.

<1> The radome 40 has been described on the assumption of being formed of one material, but is not limited thereto. The first region 40A and the second region 40B may be formed of different materials from each other. That is, when the thickness of the first region 40A is represented by da, the thickness of the second region 40B is represented by db, the wavelength of the radio wave traveling in the first region 40A is represented by λa, and the wavelength of the radio wave traveling in the second region 40B is represented by λb, the above expression (2) holds in the radome 40 in the modified example <1>. With the configuration of the radome 40, it is possible to obtain an effect equivalent to the above.

Figure 17:
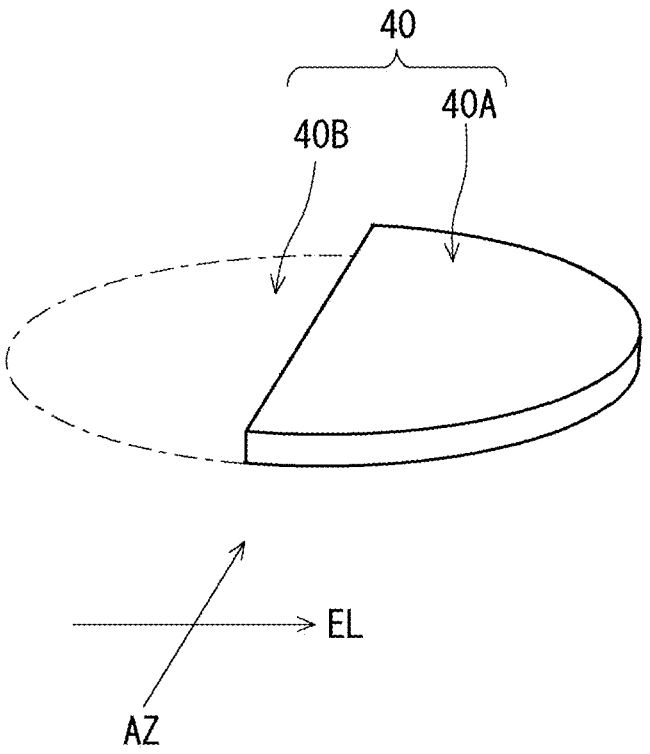
FIG. 17 is a diagram for explaining a radome of a modified example <2> in the third example embodiment.

<2> In addition, as shown in FIG. 17, the radome 40 may include the second region 40B as an air layer. That is, the radome 40 may be a semicircular-shaped disc (corresponding to the first region 40A). With the configuration of the radome 40, it is possible to obtain an effect equivalent to the above. FIG. 17 is a diagram for explaining a radome of the modified example <2> in the third example embodiment.

<3> Furthermore, the radome 40 may be considered in the same manner as the modified example <3> in the first example embodiment, and the first region 40A and the second region 40B may have different layer structures from each other. That is, the radome 40 may have a structure in which a semicircular disc is stacked on a disc formed of different material from the semicircular disc.

Fourth Example Embodiment

A fourth example embodiment relates to a radome in which a first region and a second region each include a plurality of partial regions, and the arrangement pattern of the partial regions of the first region and the arrangement pattern of the partial regions of the second region each have rotational symmetry about the center of the radome having a circular shape in plane view. Note that, the basic configuration of an antenna device in the fourth example embodiment is the same as the antenna device 1 in the first example embodiment, and is described with reference to FIG. 1.

<Configuration Example of Radome>

Figure 18:
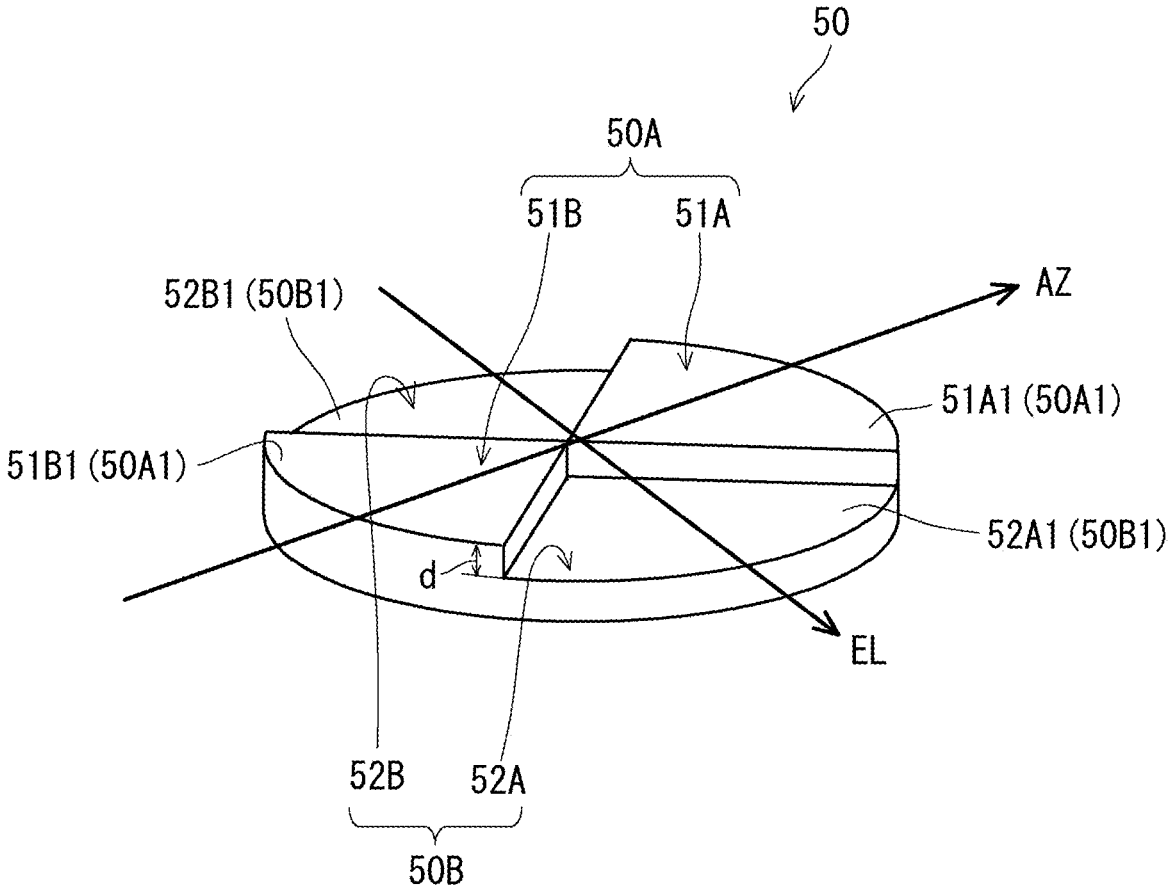
FIG. 18 is a perspective view showing an example of a radome in a fourth example embodiment.

FIG. 18 is a perspective view showing an example of a radome in the fourth example embodiment.

A radome 50 in the fourth example embodiment includes a first region 50A and a second region 50B having different "radio-wave transmission characteristics" from each other similarly to the radome 20 in the first example embodiment. The radome 50 has a plate shape, and a circular shape in plane view similarly to the radome 20 in the first example embodiment. In addition, the first region 50A and the second region 50B are formed of the same material (for example, resin), but have different thicknesses from each other in the facing direction. Specifically, the first region 50A is thicker than the second region 50B by the difference d as shown in FIG. 18. That is, a step is formed at the boundary between the first region 50A and the second region 50B. The difference d is set so that a first phase of a first radio wave passing through the first region 50A in a front side face 50A1 of the first region 50A is to be the opposite phase to a second phase of a second radio wave passing through the second region 50B in the plane including the front side face 50A1 of the first region 50A. That is, the above expression (1) holds in the fourth example embodiment.

On the other hand, in the radome 50 in the fourth example embodiment, the first region 50A includes two partial regions 51A and 51B. The second region 50B includes two partial regions 52A and 52B. Then, in four sectors obtained by dividing the circle of the radome 50 into four equal parts (that is, four quadrants), one pair of two sectors that are not adjacent to each other consists of the partial region 51A and the partial region 51B, and the other pair of two sectors consists of the partial region 52A and the partial region 52B. For this reason, the area of the front side face 50A1 of the first region 50A (that is, the sum of the area of a front side face 51A1 of the partial region 51A and the area of a front side face 51B1 of the partial region 51B) is equal to the area of a front side face 50B1 of the second region 50B (that is, the sum of the area of a front side face 52A1 of the partial region 52A and the area of a front side face 52B1 of the partial region 52B).

Thus, the arrangement pattern of the partial region 51A and the partial region 51B included in the first region 50A has rotational symmetry with respect to the center of the circle of the radome 50 in plane view. In addition, the arrangement pattern of the partial region 52A and the partial region 52B included in the second region 50B has rotational symmetry with respect to the center of the circle of the radome 50 in plane view.

<Description of Formation Pattern>

Figure 19:
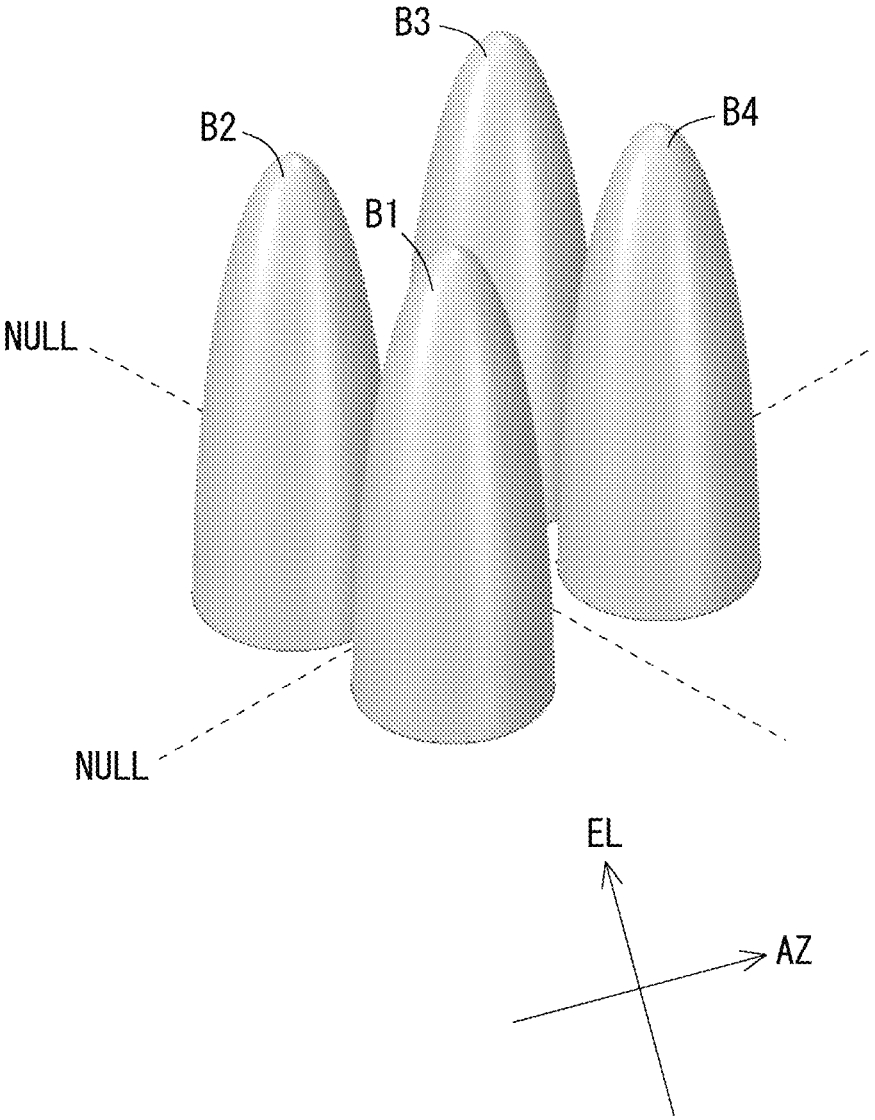
FIG. 19 is a diagram schematically showing a formation pattern in the fourth example embodiment.

A directivity pattern of a radio wave radiated from an antenna device 1 including the radome 50 having the above configuration, that is, a formation pattern formed by the antenna device 1 is described below. FIG. 19 is a diagram schematically showing a formation pattern in the fourth example embodiment. Here, the description is made on the assumption that the azimuth-axis direction and the elevation-axis direction have been set as shown in FIGS. 18 and 19, that is, on the assumption that the directions obtained by rotating the two boundaries between the first region 50A and the second region 50B by 45° are aligned with the azimuth-axis direction and the elevation-axis direction.

As shown in FIG. 19, the formation pattern of the radio wave radiated from the antenna device 1 in the fourth example embodiment, that is, the directivity pattern of the radio wave that has passed through the radome 50 is different from the directivity pattern in the first example embodiment (FIG. 4) in that a null is formed in the entire directions of the two boundaries between the first region 50A and the second region 50B. In other words, the main lobe and the side lobe becomes a null in the entire directions of the two boundaries between the first region 50A and the second region 50B. That is, as shown in FIG. 19, four beams B1, B2, B3, and B4 appear at the four positions corresponding to the partial regions 51A, 51B, 52A, and 52B. For this reason, the pattern obtained by cutting the formation pattern of the radio wave radiated from the antenna device 1 in the fourth example embodiment in the plane orthogonal to the azimuth-axis direction or the elevation-axis direction is the same as the pattern (solid line) shown in FIG. 5 in the first example embodiment. In addition, in the pattern obtained by cutting the formation pattern in the plane orthogonal to the azimuth-axis direction, the phases of the peaks on the left and right sides of the null are inverted. In addition, in the pattern obtained by cutting the formation pattern in the plane orthogonal to the elevation-axis direction, the phases of the peaks on the left and right sides of the null are inverted.

Figure 20:
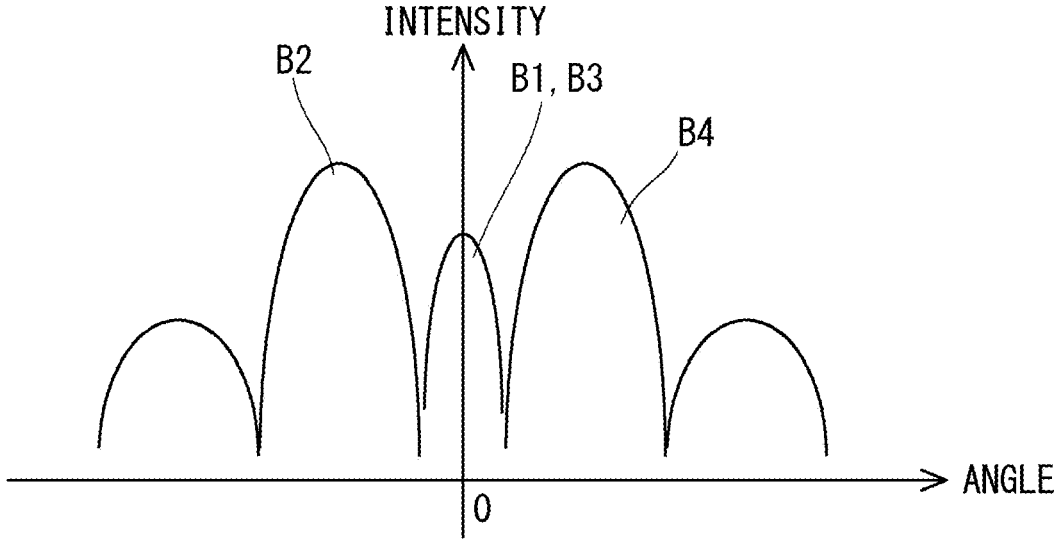
FIG. 20 is a diagram for explaining a reception beam pattern in the fourth example embodiment.

Here, when the azimuth angle of the antenna device 1 has been adjusted, the peaks corresponding to the beam B2 and the beam B4 appear, and the pattern obtained by cutting the reception pattern of the reception-side antenna in the plane orthogonal to the elevation-axis direction becomes the same as the pattern (solid line) shown in FIG. 5 in the first example embodiment. On the other hand, when the azimuth angle of the antenna device 1 has not been adjusted, the peak corresponding to the beam B1 or the beam B3 appears in the vicinity of the angle zero, which is to be a null, as shown in FIG. 20 in the pattern obtained by cutting the reception pattern of the reception-side antenna in the plane orthogonal to the elevation-axis direction. Thus, in the pattern obtained by cutting the reception pattern of the reception-side antenna in the plane orthogonal to the elevation-axis direction, it is determined that the adjustment of the azimuth angle is insufficient when the peak appears in the vicinity of the angle zero, or it is determined that the adjustment of the azimuth angle is sufficient when a null is formed in the vicinity of the angle zero, and it is possible to easily adjust the azimuth angle. Similarly, in the pattern obtained by cutting the reception pattern of the reception-side antenna in the plane orthogonal to the azimuth-axis direction, it is determined that the adjustment of the elevation angle is insufficient when the peak appears in the vicinity of the angle zero, or it is determined that the adjustment of the elevation angle is sufficient when a null is formed in the vicinity of the angle zero and it is possible to easily adjust the elevation angle. For this reason, it is possible to easily adjust the antenna direction and to improve the work for installing the radio system as a result.

As described above, according to the fourth example embodiment, the first region 50A includes the two partial regions 51A and 51B, and the second region 50B includes the two partial regions 52A and 52B in the radome 50. The arrangement pattern of the partial region 51A and the partial region 51B is a pattern having rotational symmetry in plane view, and the arrangement pattern of the partial region 52A and the partial region 52B is a pattern having rotational symmetry in plane view.

With the configuration of the radome 50, it is possible to determine, based on the presence of the peak in the vicinity of the angle zero, whether the adjustment of the antenna direction is insufficient or not as described above, and it is possible to more easily adjust the antenna direction and to improve the efficiency of the work for installing the radio system as a result.

<Modified Example>

The radome 50 in the fourth example embodiment may be modified as follows.

<1> The radome 50 has been described on the assumption of being formed of one material, but is not limited thereto. The first region 50A and the second region 50B may be formed of different materials from each other. That is, when the thickness of the first region 50A is represented by da, the thickness of the second region 50B is represented by db, the wavelength of the radio wave traveling in the first region 50A is represented by λa, and the wavelength of the radio wave traveling in the second region 50B is represented by λb, the above expression (2) holds in the radome 50 in the modified example <1>. With the configuration of the radome 50, it is possible to obtain an effect equivalent to the above.

Figure 21:
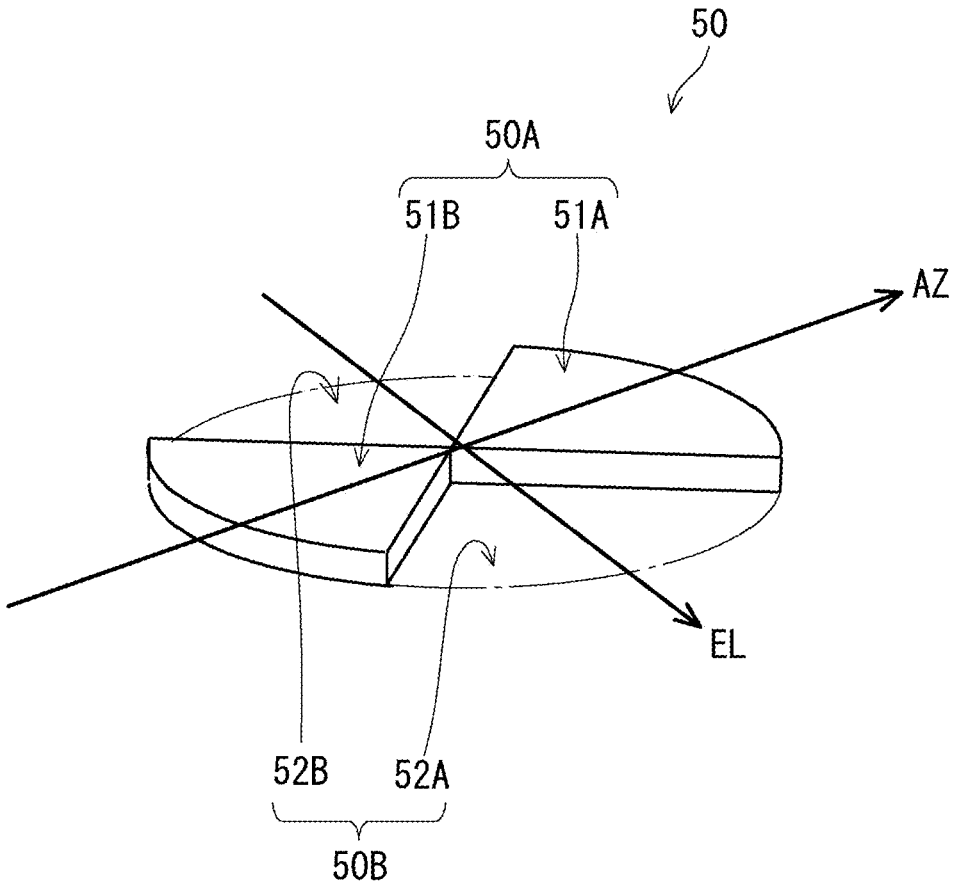
FIG. 21 is a diagram for explaining a radome of a modified example <2> in the fourth example embodiment.

<2> In addition, as shown in FIG. 21, the radome 50 may include the second region 50B as an air layer. That is, the radome 50 may have a structure in which the portion corresponding to the second region 50B is cut out. With the configuration of the radome 50, it is possible to obtain an effect equivalent to the above.

<3> Furthermore, the radome 50 may be considered in the same manner as the modified example <3> in the first example embodiment, and the first region 50A and the second region 50B may have different layer structures from each other. That is, the radome 50 may have a structure in which quadrant discs each having a sector shape in plane view are stacked at different positions on a disc formed of different material from the quadrant discs.

Fifth Example Embodiment

A fifth example embodiment relates to a radome having a plate shape, and a quadrangular shape in plane view. Note that, the basic configuration of an antenna device in the fifth example embodiment is the same as the antenna device 1 in the first example embodiment, and is described with reference to FIG. 1.

Figure 22:
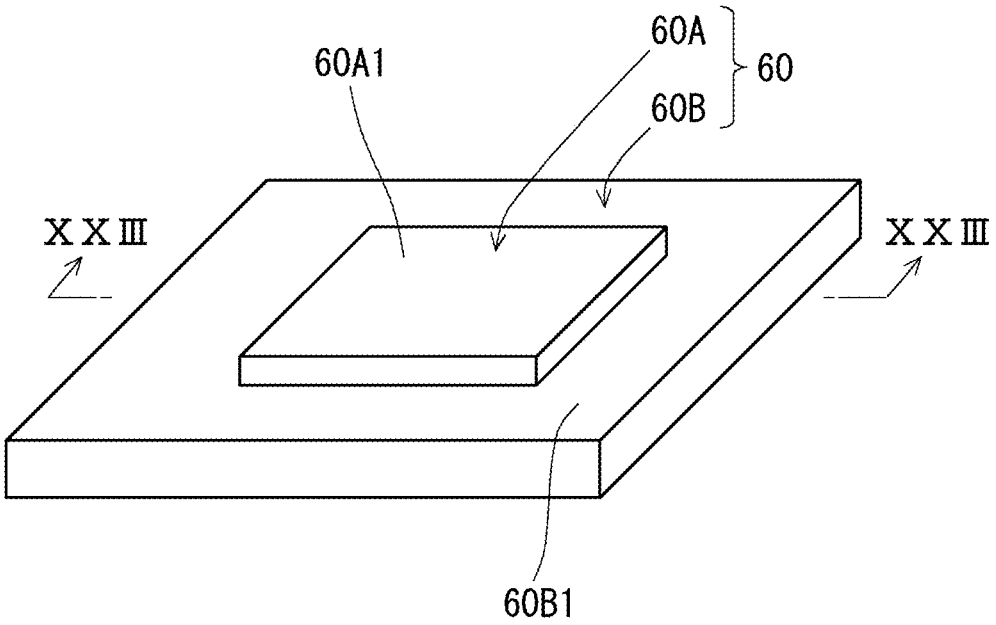
FIG. 22 is a perspective view showing an example of a radome in a fifth example embodiment.
Figure 23:
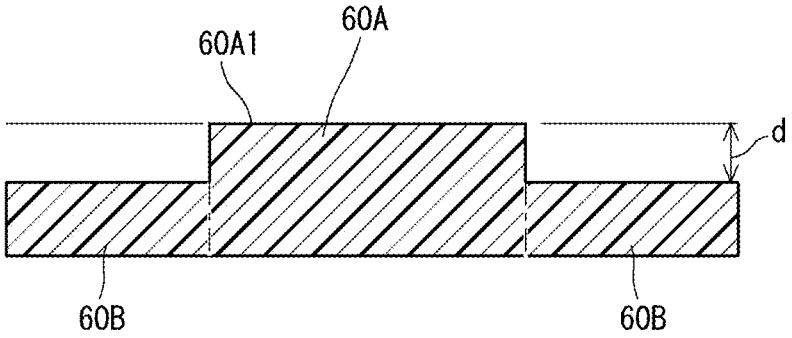
FIG. 23 is a cross-sectional view taken in the direction of the arrows XXIII-XXIII in FIG. 22.

FIG. 22 is a perspective view showing an example of a radome in the fifth example embodiment. FIG. 23 is a cross-sectional view taken in the direction of the arrows XXIII-XXIII in FIG. 22.

A radome 60 in the fifth example embodiment is arranged on the front side of an antenna main body 10 to face the antenna main body 10 similarly to the radome 20 in the first example embodiment. The radome 60 transmits a radiation radio wave of the antenna main body 10.

The radome 60 includes a first region 60A and a second region 60B having different "radio-wave transmission characteristics" from each other similarly to the radome 20 in the first example embodiment. In addition, similarly to the radome 20 in the first example embodiment, the first region 60A and the second region 60B are formed of the same material, but the first region 60A is thicker than the second region 60B by the difference d. That is, the above expression (1) holds.

In addition, similarly to the radome 20 in the first example embodiment, a first area of a front side face 60A1 of the first region 60A and a second area of a front side face 60B1 of the second region 60B are set so that the absolute value of the integration of the magnetic field that has passed through the front side face 60A1 (that is, the total sum of the magnetic field vectors) is to be equal to the absolute value of the integration of the magnetic field that has passed through the front side face 60B1.

On the other hand, the radome 60 is different from the radome 20 in the first example embodiment in that the radome 60 has a plate shape, and a quadrangular shape in plane view. The first region 60A is a quadrangular region in plane view, and the intersection point of the diagonal lines of the first region 60A is matched with the intersection point of the diagonal lines of the radome 20. That is, the first region 60A is a center region of the radome 60. The second region 60B is a peripheral region surrounding the first region 60A. That is, the first region 60A is a surrounded region surrounded by the second region 60B. Thus, the arrangement pattern of the first region 60A and the second region 60B in plane view has line symmetry with respect to the diagonal lines of the radome 20, and has rotational symmetry with respect to the intersection point of the diagonal lines of the radome 20.

In the configuration of the radome 60 in the fifth example embodiment, similarly to the first example embodiment, a first radio wave and a second radio wave have the opposite phases to each other by passing through the radome 60 and the same absolute value of the integration, and cancel each other. As the result of this, a null pattern is formed in substantially the front direction of the antenna.

Thus, with the configuration of the radome 60, it is possible to form a directivity pattern having "the characteristic that the high-intensity portion appears in a wide angle" and "the characteristic that the sensitivity in the vicinity of the front direction is high", and it is possible to easily adjust the antenna direction and to improve the efficiency of the work for installing the radio system as a result.

<Modified Example>

The radome 60 in the fifth example embodiment may be modified as follows.

<1> The radome 60 has been described on the assumption of being formed of one material, but is not limited thereto. The first region 60A and the second region 60B may be formed of different materials from each other.

Figure 24:
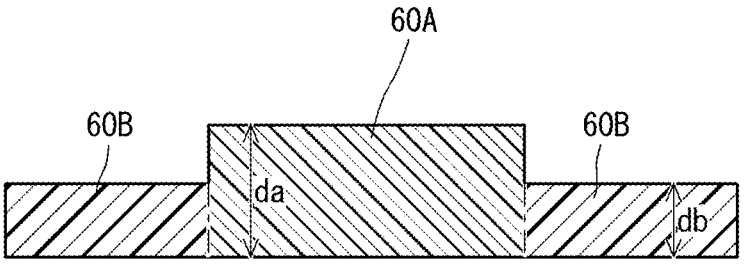
FIG. 24 is a diagram for explaining a radome of a modified example <1> in the fifth example embodiment.

FIG. 24 is a diagram for explaining a radome of the modified example <1> in the fifth example embodiment. As shown in FIG. 24, when the thickness of the first region 60A is represented by da, the thickness of the second region 60B is represented by db, the wavelength of the radio wave traveling in the first region 60A is represented by λa, and the wavelength of the radio wave traveling in the second region 60B is represented by λb, the above expression (2) holds in the radome 60 in the modified example <1>.

With the configuration of the radome 60, it is possible to obtain an effect equivalent to the above.

Figure 25:
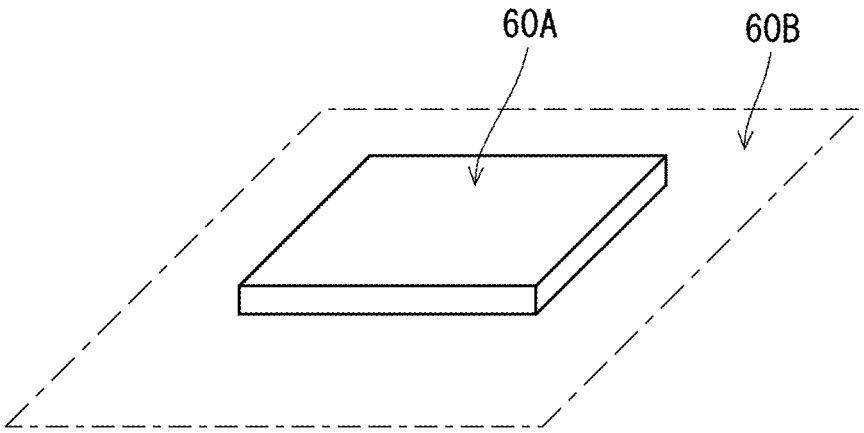
FIG. 25 is a diagram for explaining a radome of a modified example <2> in the fifth example embodiment.

<2> In addition, as shown in FIG. 25, the radome 60 may include the second region 60B as an air layer. With the configuration of the radome 60, it is possible to obtain an effect equivalent to the above. FIG. 25 is a diagram for explaining a radome of the modified example <2> in the fifth example embodiment.

Figure 26:
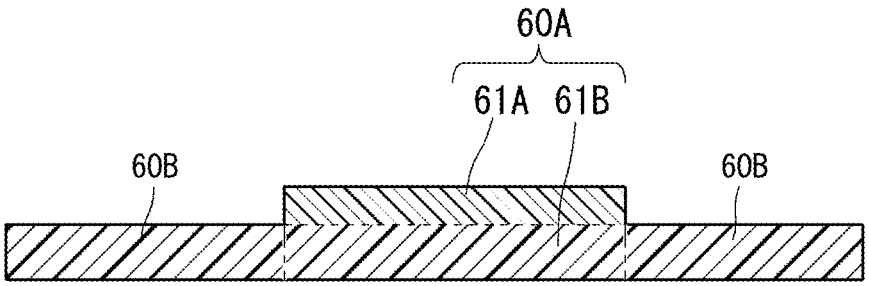
FIG. 26 is a diagram for explaining a radome of a modified example <3> in the fifth example embodiment.

<3> Furthermore, the radome 60 may be considered in the same manner as the modified example <3> in the first example embodiment, and the first region 60A and the second region 60B may have different layer structures from each other as shown in FIG. 26. That is, as shown in FIG. 26, the radome 60 may have a structure in which a second flat plate including a first layer 61A and smaller than a first flat plate is stacked on the first flat plate including a second layer 61B and the second region 60B and having a quadrangular shape in plane view. FIG. 26 is a diagram for explaining a radome of the modified example <3> in the fifth example embodiment.

In the configuration of the radome 60, since the first layer 61A and the air layer contribute the phase difference between the first radio wave and the second radio wave, and the above expression (1) holds. Thus, with the configuration of the radome 60, it is possible to obtain an effect equivalent to the above.

Sixth Example Embodiment

A sixth example embodiment relates to a radome in which a first region is thinner than a second region in contrast to the fifth example embodiment. Note that, the basic configuration of an antenna device in the sixth example embodiment is the same as the antenna device 1 in the first example embodiment, and is described with reference to FIG. 1.

Figure 27:
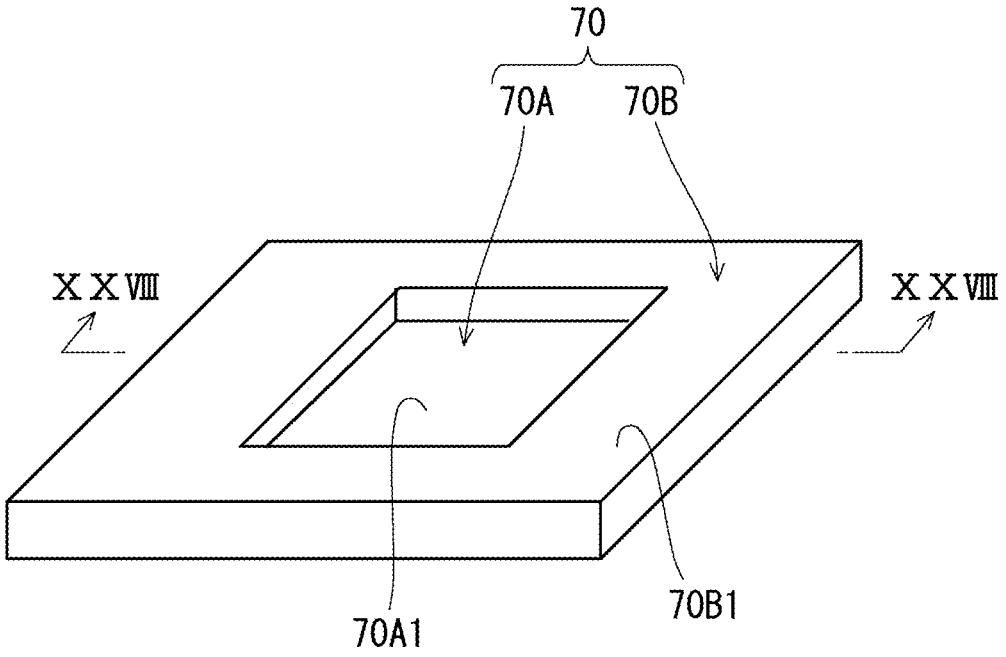
FIG. 27 is a perspective view showing an example of a radome in a sixth example embodiment.
Figure 28:
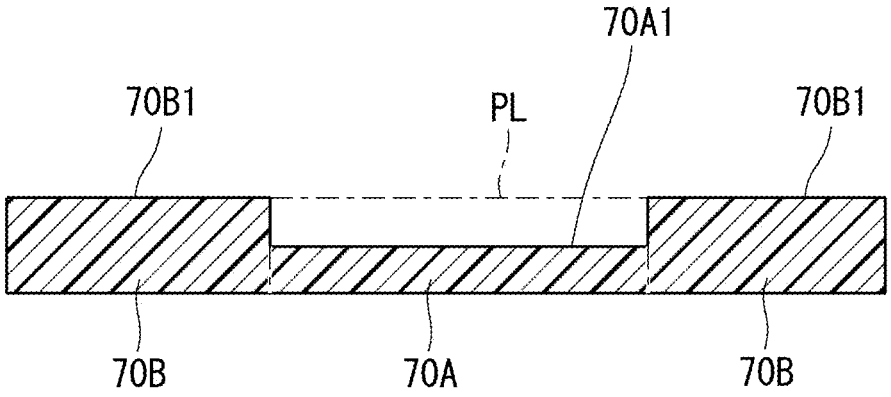
FIG. 28 is a cross-sectional view taken in the direction of the arrows XXVIII-XXVIII in FIG. 27.

FIG. 27 is a perspective view showing an example of a radome in the sixth example embodiment. FIG. 28 is a cross-sectional view taken in the direction of the arrows XXVIII-XXVIII in FIG. 27.

A radome 70 in the sixth example embodiment is arranged on the front side of an antenna main body 10 to face the antenna main body 10 similarly to the radome 20 in the first example embodiment. The radome 70 transmits a radiation radio wave of the antenna main body 10.

The radome 70 includes, similarly to the radome 60 in the fifth example embodiment, a first region 70A and a second region 70B having different "radio-wave transmission characteristics" from each other. In addition, similarly to the radome 60 in the fifth example embodiment, the radome 70 has a plate shape, and a quadrangular shape in plane view. The first region 70A is a surrounded region having a quadrangular shape in plane view, and the second region 70B is a peripheral region surrounding the first region 70A. The first region 70A and the second region 70B are formed of the same material (for example, resin), but have different thicknesses from each other in the facing direction.

On the other hand, the radome 70 is different from the radome 60 in the fifth example embodiment in that the second region 70B is thicker than the first region 70A by the difference d. The difference d is set so that a first phase of a first radio wave in a plane PL including a front side face 70B1 of the second region 70B is to be the opposite phase to a second phase of a second radio wave in a front side face 70B1 of the second region 70B. That is, the above expression (1) holds in the sixth example embodiment.

In addition, similarly to the radome 60 in the fifth example embodiment, a first area of a front side face 70A1 of the first region 70A and a second area of the front side face 70B1 of the second region 70B are set so that the absolute value of the integration of the magnetic field that has passed through the front side face 70A1 (that is, the total sum of the magnetic field vectors) is to be equal to the absolute value of the integration of the magnetic field that has passed through the front side face 70B1.

In the configuration of the radome 70 in the sixth example embodiment, similarly to the fifth example embodiment, the first radio wave and the second radio wave have the opposite phases to each other by passing through the radome 70 and the same absolute value of the integration, and cancel each other. As the result of this, a null pattern is formed in substantially the front direction of the antenna.

Thus, with the configuration of the radome 70, it is possible to form a directivity pattern having "the characteristic that the high-intensity portion appears in a wide angle" and "the characteristic that the sensitivity in the vicinity of the front direction is high", and it is possible to easily adjust the antenna direction and to improve the efficiency of the work for installing the radio system as a result.

<Modified Example>

The radome 70 in the sixth example embodiment may be modified as follows.

<1> The radome 70 has been described on the assumption of being formed of one material, but is not limited thereto. The first region 70A and the second region 70B may be formed of different materials from each other.

Figure 29:
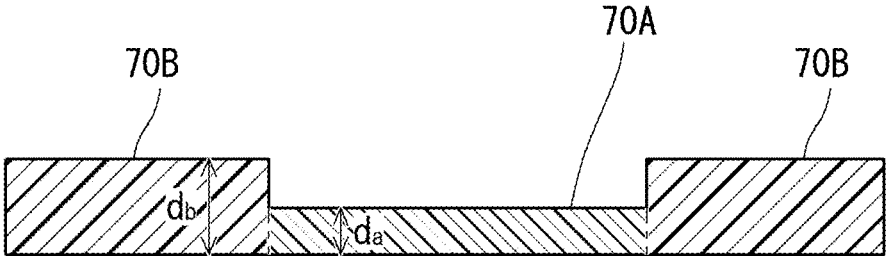
FIG. 29 is a diagram for explaining a radome of a modified example <1> in the sixth example embodiment.

FIG. 29 is a diagram for explaining a radome of the modified example <1> in the sixth example embodiment. As shown in FIG. 29, when the thickness of the first region 70A is represented by da, the thickness of the second region 70B is represented by db, the wavelength of the radio wave traveling in the first region 70A is represented by λa, and the wavelength of the radio wave traveling in the second region 70B is represented by λb, the above expression (2) holds in the radome 70 in the modified example <1>.

With the configuration of the radome 70, it is possible to obtain an effect equivalent to the above.

Figure 30:
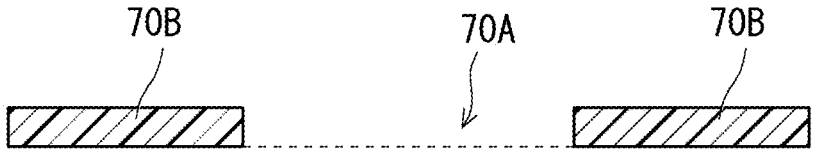
FIG. 30 is a diagram for explaining a radome of a modified example <2> in the sixth example embodiment.

<2> In addition, as shown in FIG. 30, the radome 70 may include the first region 70A as an air layer. That is, the radome 70 may be a flat plate having a through hole at the position corresponding to the first region 70A. With the configuration of the radome 70, it is possible to obtain an effect equivalent to the above. FIG. 30 is a cross-sectional view for explaining a radome of the modified example <2> in the sixth example embodiment.

Figure 31:
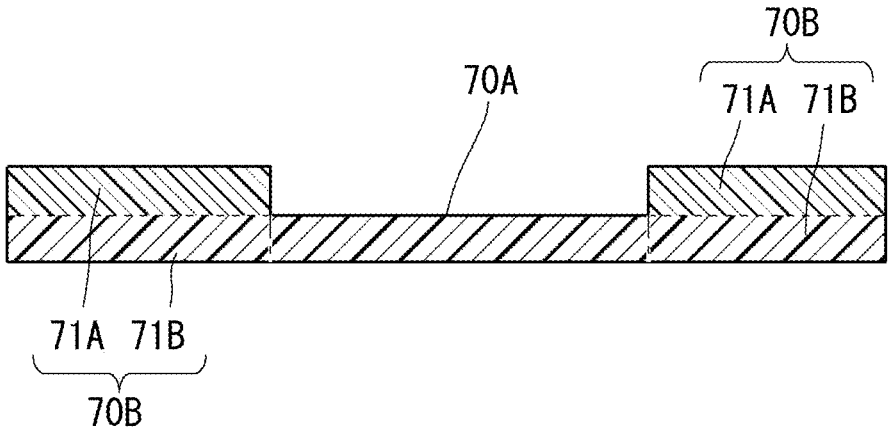
FIG. 31 is a diagram for explaining a radome of a modified example <3> in the sixth example embodiment.

<3> Furthermore, the radome 70 may be considered in the same manner as the modified example <3> in the second example embodiment, and the first region 70A and the second region 70B may have different layer structures from each other as shown in FIG. 31. That is, as shown in FIG. 31, the radome 70 may have a structure in which a second flat plate is stacked on a first flat plate. The second flat plate includes a first layer 71A, has a through hole having a quadrangular shape in plane view at the position corresponding to the first region 70A, has the same size as the first flat plate, and is formed of different material from the first flat plate. The first flat plate includes the first region 70A and a second layer 71B, and has a quadrangular shape in plane view. FIG. 31 is a diagram for explaining a radome of the modified example <3> in the sixth example embodiment.

Seventh Example Embodiment

A seventh example embodiment relates to a radome including a first region and a second region and having a quadrangular shape in plane view, in which two divided regions obtained by dividing the quadrangle of the radome into two parts are the first region and the second region. Note that, the basic configuration of an antenna device in the seventh example embodiment is the same as the antenna device 1 in the first example embodiment, and is described with reference to FIG. 1.

Figure 32:
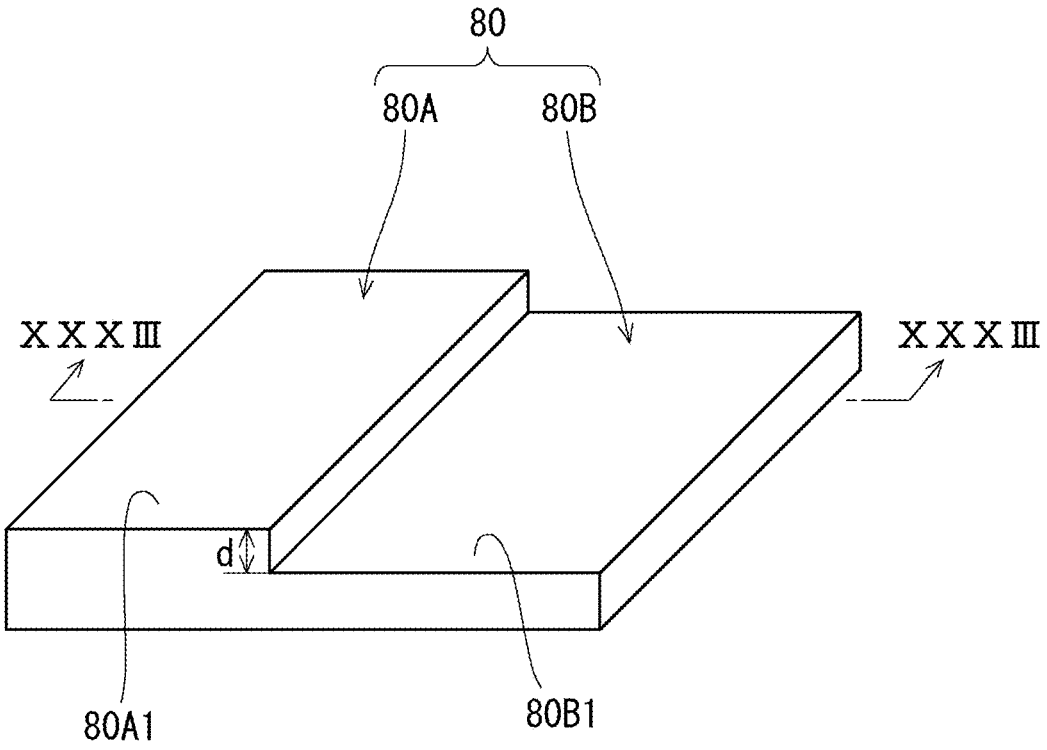
FIG. 32 is a perspective view showing an example of a radome in a seventh example embodiment.
Figure 33:
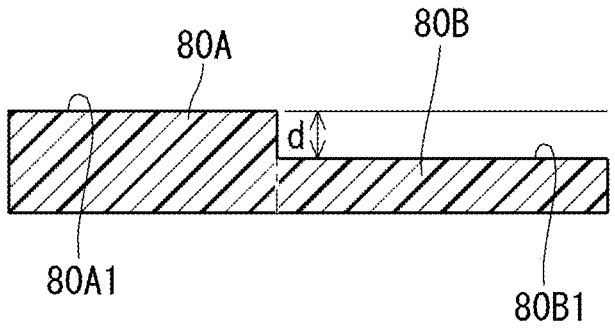
FIG. 33 is a cross-sectional view taken in the direction of the arrows XXXIII-XXXIII in FIG. 32.

FIG. 32 is a perspective view showing an example of a radome in the seventh example embodiment. FIG. 33 is a cross-sectional view taken in the direction of the arrows XXXIII-XXXIII in FIG. 32.

A radome 80 in the seventh example embodiment is arranged on the front side of an antenna main body 10 to face the antenna main body 10 similarly to the radome 40 in the third example embodiment. The radome 80 transmits a radiation radio wave of the antenna main body 10.

The radome 80 includes, similarly to the radome 40 in the third example ¯ quadrangular shape in plane view. The first region 80A and the second region 80B correspond to two divided regions obtained by dividing the quadrangle of the radome 80 into two parts (that is, two-divided quadrangular regions). Thus, the arrangement pattern of the first region 80A and the second region 80B has line symmetry with respect to the boundary between the first region 80A and the second region 80B, and rotational symmetry with respect to the intersection point of the diagonal lines of the radome 80.

With the configuration of the radome 80 in the seventh example embodiment, it is possible to form a directivity pattern having a null in the direction of the boundary face between the first region 80A and the second region 80B similarly to the third example embodiment, and it is possible to more easily search for the null portion of the formation pattern using the reception-side antenna. In addition, the phases on both sides of the boundary between the first region 80A and the second region 80B are inverted, and it is possible to more easily search for the null portion of the formation pattern using the reception-side antenna. For this reason, it is possible to easily adjust the antenna direction and to improve the work for installing the radio system as a result.

<Modified Example>

The radome 80 in the seventh example embodiment may be modified as follows.

<1> The radome 80 has been described on the assumption of being formed of one material, but is not limited thereto. The first region 80A and the second region 80B may be formed of different materials from each other.

Figure 34:
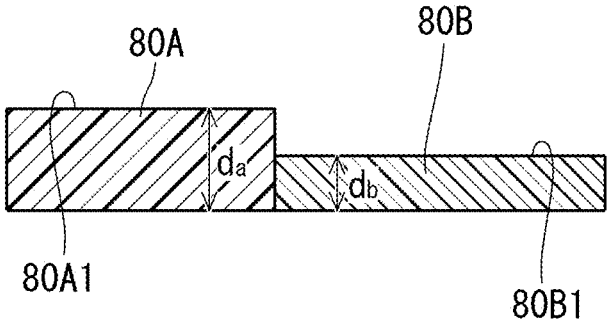
FIG. 34 is a diagram for explaining a radome of a modified example <1> in the seventh example embodiment.

FIG. 34 is a diagram for explaining a radome of the modified example <1> in the seventh example embodiment. As shown in FIG. 34, when the thickness of the first region 80A is represented by da, the thickness of the second region 80B is represented by db, the wavelength of the radio wave traveling in the first region 80A is represented by λa, and the wavelength of the radio wave traveling in the second region 80B is represented by λb, the above expression (2) holds in the radome 80 in the modified example <1>.

With the configuration of the radome 80, it is possible to obtain an effect equivalent to the third example embodiment.

Figure 35:
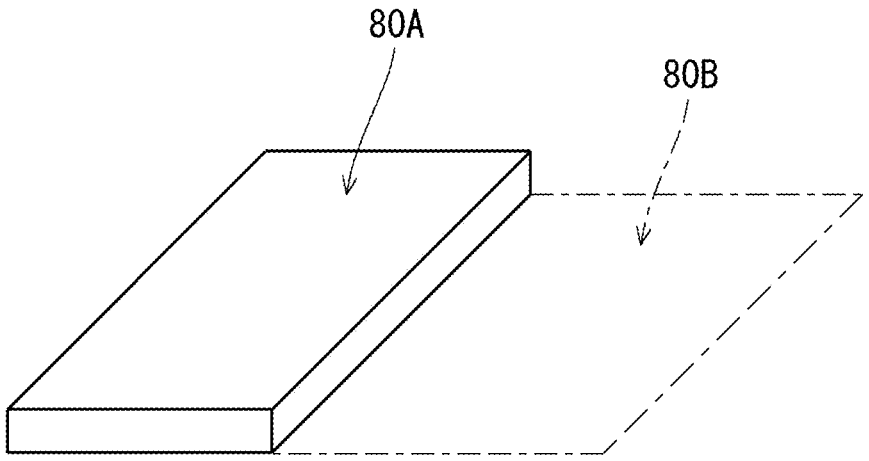
FIG. 35 is a diagram for explaining a radome of a modified example <2> in the seventh example embodiment.

<2> In addition, as shown in FIG. 35, the radome 80 may include the second region 80B as an air layer. With the configuration of the radome 80, it is possible to obtain an effect equivalent to the above. FIG. 35 is a diagram for explaining a radome of the modified example <2> in the seventh example embodiment.

Figure 36:
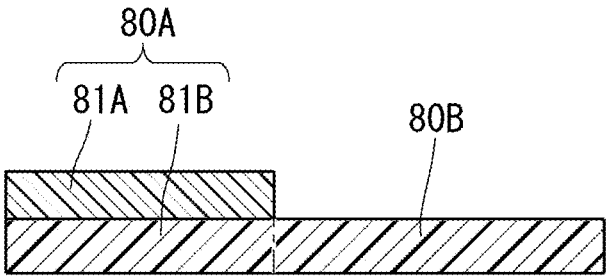
FIG. 36 is a diagram for explaining a radome of a modified example <3> in the seventh example embodiment.

<3> Furthermore, the radome 80 may be considered in the same manner as the modified example <3> in the third example embodiment, and the first region 80A and the second region 80B may have different layer structures from each other as shown in FIG. 36. That is, as shown in FIG. 36, the radome 80 may have a structure in which a second flat plate including a first layer 81A and smaller than a first flat plate is stacked on the first flat plate including a second layer 81B and the second region 80B and having a quadrangular shape in plane view. FIG. 36 is a diagram for explaining a radome of the modified example <3> in the seventh example embodiment.

In the configuration of the radome 80, since the first layer 81A and the air layer contribute the phase difference between a first radio wave and a second radio wave, and the above expression (1) holds. Thus, with the configuration of the radome 80, it is possible to obtain an effect similar to the third example embodiment.

Eighth Example Embodiment

An eighth example embodiment relates to a radome in which a first region and a second region each include a plurality of partial regions similarly to the fourth example embodiment. However, the radome in the eighth example embodiment is different from the fourth example embodiment in that the radome has a quadrangular shape in plane view. The arrangement pattern of the partial regions included in the first region of the radome in the eighth example embodiment and the arrangement pattern of the partial regions included in the second region each have rotational symmetry about the intersection point of the diagonal lines of the quadrangular radome in plane view. Note that, the basic configuration of an antenna device in the eighth example embodiment is the same as the antenna device 1 in the first example embodiment, and is described with reference to FIG. 1.

Figure 37:
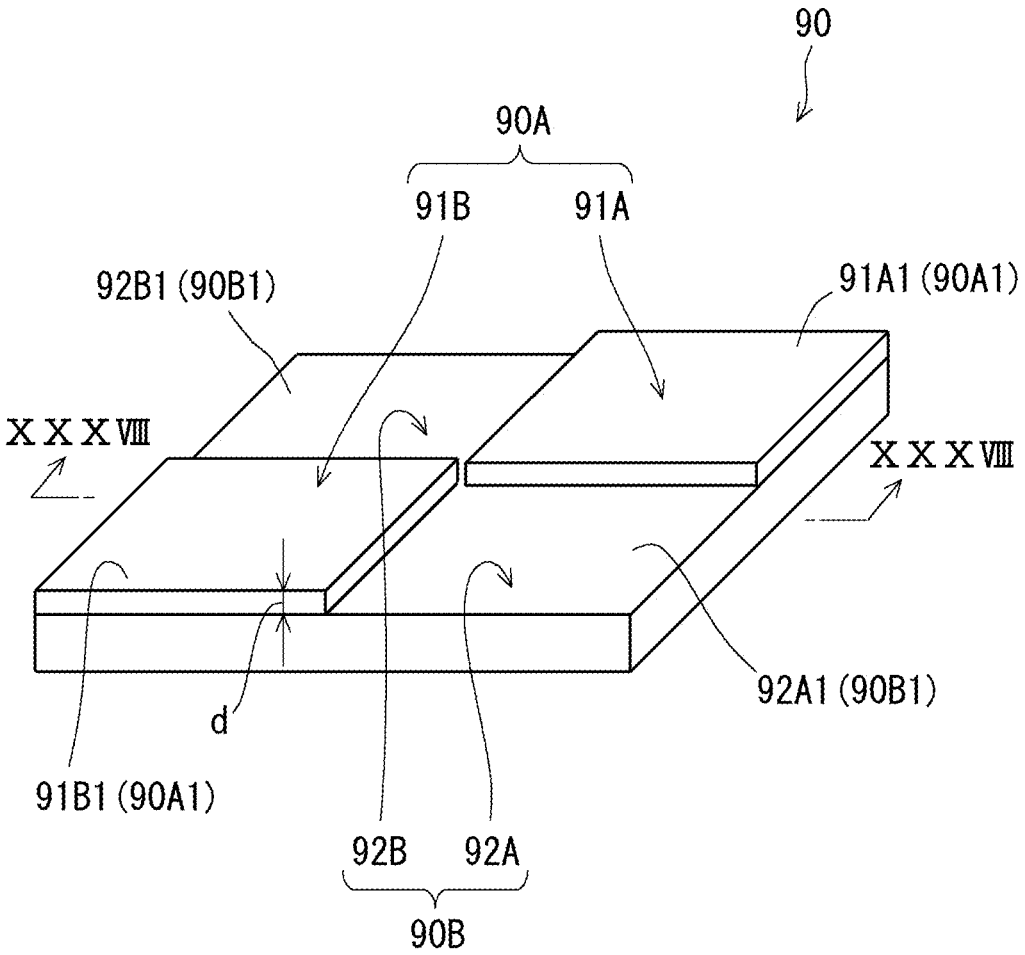
FIG. 37 is a perspective view showing an example of a radome in an eighth example embodiment.
Figure 38:
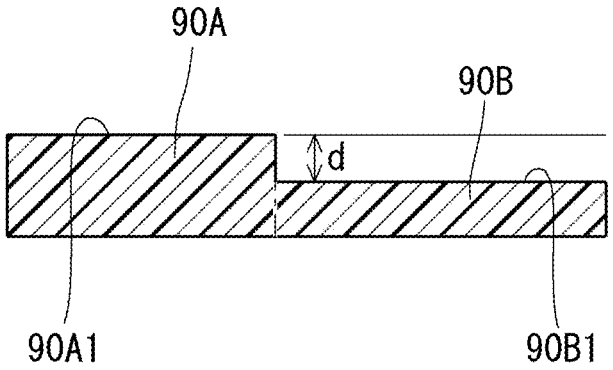
FIG. 38 is a cross-sectional view taken in the direction of the arrows XXXVIII-XXXVIII in FIG. 37.

FIG. 37 is a perspective view showing an example of a radome in the eighth example embodiment. FIG. 38 is a cross-sectional view taken in the direction of the arrows XXXVIII-XXXVIII in FIG. 37.

A radome 90 in the eighth example embodiment is arranged on the front side of an antenna main body 10 to face the antenna main body 10 similarly to the radome 50 in the fourth example embodiment. The radome 90 transmits a radiation radio wave of the antenna main body 10.

The radome 90 includes a first region 90A and a second region 90B having different "radio-wave transmission characteristics" from each other similarly to the radome 50 in the fourth example embodiment. In addition, similarly to the radome 50 in the fourth example embodiment, the first region 90A and the second region 90B are formed of the same material, but the first region 90A is thicker than the second region 90B by the difference d. That is, the above expression (1) holds.

In the radome 90 in the eighth example embodiment, the first region 90A includes two partial regions 91A and 91B similarly to the radome 50 in the fourth example embodiment. The second region 90B includes two partial regions 92A and 92B.

In addition, similarly to the radome 50 in the fourth example embodiment, a first area of a front side face 90A1 of the first region 90A and a second area of a front side face 90B1 of the second region 90B are set so that the absolute value of the integration of the magnetic field that has passed through the front side face 90A1 (that is, the total sum of the magnetic field vectors) is to be equal to the absolute value of the integration of the magnetic field that has passed through the front side face 90B1. That is, the sum of the area of a front side face 91A1 of the partial region 91A and the area of a front side face 91B1 of the partial region 91B is equal to the sum of the area of a front side face 92A1 of the partial region 92A and the area of a front side face 92B1 of the partial region 92B.

On the other hand, the radome 90 is different from the radome 50 in the fourth example embodiment in that the radome 90 has a plate shape, and a quadrangular shape in plane view. Then, in four partial regions obtained by dividing the quadrangle of the radome 90 into four parts each including one of the four vertices of the quadrangle (that is, four-divided quadrangular regions), one pair of two four-divided quadrangular regions that are not adjacent to each other consists of the partial region 91A and the partial region 91B, and the other pair consists of the partial region 92A and the partial region 92B. Thus, the arrangement pattern of the partial region 91A and the partial region 91B included in the first region 90A has rotational symmetry with respect to the intersection point of the diagonal lines of the radome 90 in plane view. In addition, the arrangement pattern of the partial region 92A and the partial region 92B included in the second region 90B has rotational symmetry with respect to the intersection point of the diagonal lines of the radome 90 in plane view.

With the configuration of the radome 90 in the eighth example embodiment, it is possible to determine, based on the presence of the peak in the vicinity of the angle zero, whether the adjustment of the antenna direction is insufficient or not similarly to the fourth example embodiment, and it is possible to more easily adjust the antenna direction and to improve the efficiency of the work for installing the radio system as a result.

<Modified Example>

The radome 90 in the eighth example embodiment may be modified as follows.

Figure 39:
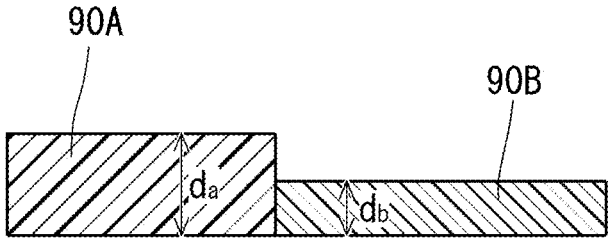
FIG. 39 is a diagram for explaining a radome of a modified example <1> in the eighth example embodiment.

<1> The radome 90 has been described on the assumption of being formed of one material, but is not limited thereto. The first region 90A and the second region 90B may be formed of different materials from each other. That is, as shown in FIG. 39, when the thickness of the first region 90A is represented by da, the thickness of the second region 90B is represented by db, the wavelength of the radio wave traveling in the first region 90A is represented by λa, and the wavelength of the radio wave traveling in the second region 90B is represented by λb, the above expression (2) holds in the radome 90 in the modified example <1>. With the configuration of the radome 90, it is possible to obtain an effect equivalent to the fourth example embodiment.

Figure 40:
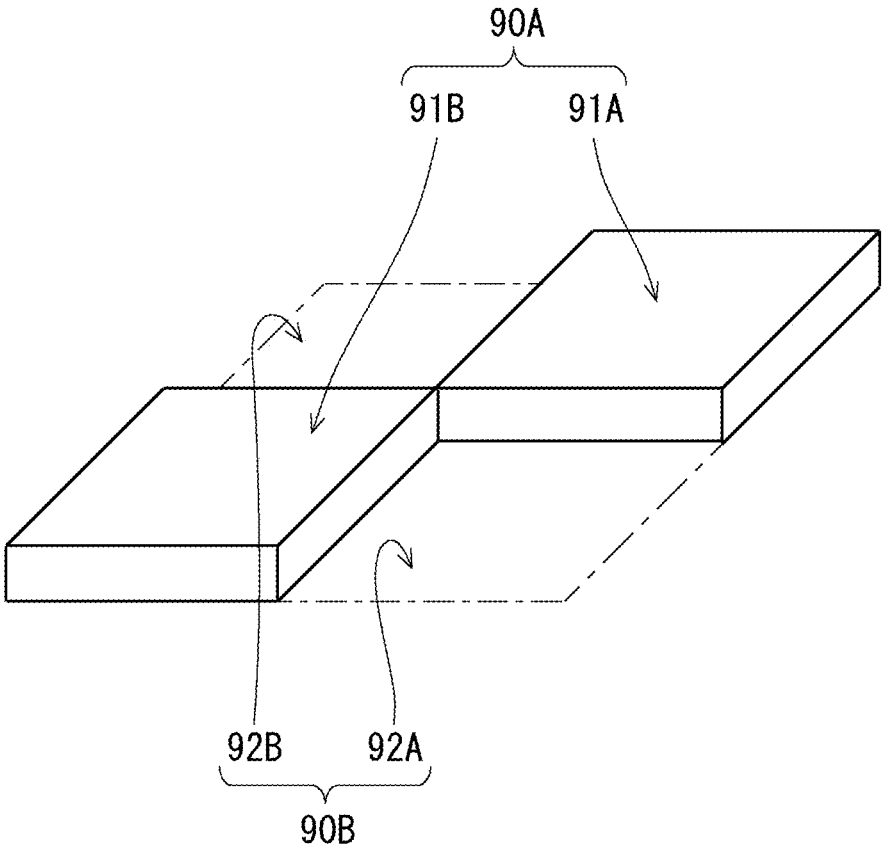
FIG. 40 is a diagram for explaining a radome of a modified example <2> in the eighth example embodiment.

<2> In addition, as shown in FIG. 40, the radome 90 may include the second region 90B as an air layer. That is, the radome 90 may have a structure in which the portion corresponding to the second region 90B is cut out. With the configuration of the radome 90, it is possible to obtain an effect equivalent to the fourth example embodiment.

Figure 41:
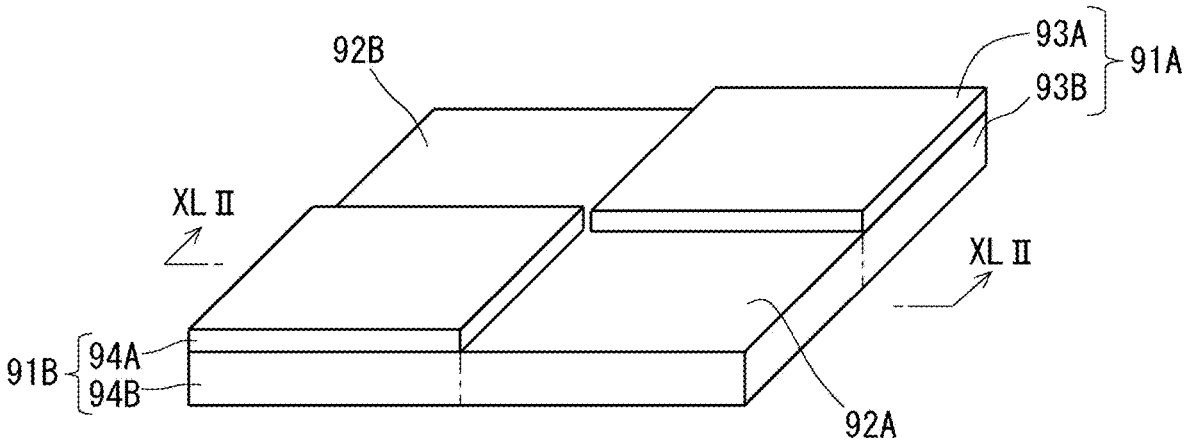
FIG. 41 is a diagram for explaining a radome of a modified example <3> in an eighth example embodiment.
Figure 42:
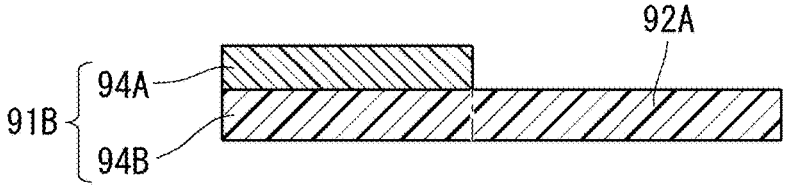
FIG. 42 is a cross-sectional view taken in the direction of the arrows XLII-XLII in FIG. 41.

<3> Furthermore, the radome 90 may be considered in the same manner as the modified example <3> in the fourth example embodiment, and the first region 90A and the second region 90B may have different layer structures from each other as shown in FIGS. 41 and 42. In FIG. 41, the partial region 91A includes a first layer 93A and a second layer 93B formed of different materials from each other. The partial region 91B includes a first layer 94A and a second layer 94B formed of different materials from each other. The first layer 93A and the first layer 94A are formed of the same material, and the second layer 93B and the second layer 94B are formed of the same material. The second layer 93B and the second layer 94B are formed of the same material as the second region 90B. As shown in FIG. 41, the radome 90 may have a structure in which two second flat plates are stacked at different positions (specifically, the diagonal positions of a first flat plate) on the first flat plate. The second flat plates are formed of different material from the first flat plate and each have a four-divided quadrangular shape in plane view. The first flat plate includes the second layer 93B, the second layer 94B, and the second region 90B, and has a quadrangular shape in plane view. FIG. 41 is a diagram for explaining a radome of the modified example <3> in an eighth example embodiment. FIG. 42 is a cross-sectional view taken in the direction of the arrows XLII-XLII in FIG. 41.

In the configuration of the radome 90, since the first layer 93A, the first layer 94A, and the air layer contribute the phase difference between a first radio wave and a second radio wave, and the above expression (1) holds. Thus, with the configuration of the radome 90, it is possible to obtain an effect similar to the fourth example embodiment.

The present invention has been described with the above example embodiments, but is not limited by the above example embodiments. Various modifications that can be understood by those skilled in the art can be made to the configurations and the details of the present invention without departing from the scope of the invention.

Part or all of the above example embodiments can be described as following Supplementary notes, but are not limited thereto.

(Supplementary Note 1)

A radome arranged to face an antenna and configured to transmit a radiation radio wave of the antenna, the radome comprising:

a first region and a second region having different radio-wave transmission characteristics from each other, wherein the radome is configured to form a null pattern in substantially a front direction of the antenna by superimposing a first radio wave that has passed through the first region and a second radio wave that has passed through the second region.

(Supplementary Note 2)

The radome according to Supplementary note 1, wherein the null pattern is formed in substantially the front direction of the antenna by the first radio wave that has passed through the first region and the second radio wave that has passed through the second region canceling each other due to a phase and amplitude relation.

(Supplementary Note 3)

The radome according to Supplementary note 1 or 2, wherein an arrangement pattern of the first region and the second region in a plane orthogonal to a direction in which the antenna faces the radome is a pattern having at least one of line symmetry and rotational symmetry.

(Supplementary Note 4)

The radome according to Supplementary note 3, wherein the radome has a circular shape in the plane, the first region is a circle region including a center of the circle, and the second region is a doughnut-shaped region surrounding the circular region.

(Supplementary Note 5)

The radome according to Supplementary note 3, wherein the radome has a circular shape in the plane, and the first region and the second region are semicircular regions.

(Supplementary Note 6)

The radome according to Supplementary note 3, wherein the radome has a circular shape in the plane, the first region and the second region each include a plurality of partial regions, and an arrangement pattern of the partial regions included in the first region and an arrangement pattern of the partial regions included in the second region are patterns each have rotational symmetry about a center of the circle.

(Supplementary Note 7)

The radome according to Supplementary note 6, wherein each of the partial regions has a sector shape.

(Supplementary Note 8)

The radome according to Supplementary note 3, wherein the radome has a quadrangular shape in the plane, the first region is a center region of the quadrangle, and the second region is a region surrounding the center region.

(Supplementary Note 9)

The radome according to Supplementary note 3, wherein the radome has a quadrangular shape in the plane, and the first region and second region correspond to two partial regions obtained by dividing the quadrangle into two parts.

(Supplementary Note 10)

The radome according to Supplementary note 3, wherein, the radome has a quadrangular shape in the plane, the first region and the second region each have a plurality of partial regions, and an arrangement pattern of the partial regions included in the first region and an arrangement pattern of the partial regions included in the second region are patterns each have rotational symmetry about an intersection point of diagonal lines of the quadrangle.

(Supplementary Note 11)

The radome according to Supplementary note 10, wherein each of the partial regions is a four-divided quadrangular region obtained by dividing the quadrangle into four parts each including one of the four vertices of the quadrangle.

(Supplementary Note 12)

The radome according to any one of Supplementary notes 1 to 11, wherein the first region and the second region have different thicknesses from each other.

(Supplementary Note 13)

The radome according to any one of Supplementary notes 1 to 11, wherein the first region and the second region are formed of different materials from each other.

(Supplementary Note 14)

The radome according to any one of Supplementary notes 1 to 11, wherein the first region or the second region is an air layer.

(Supplementary Note 15)

The radome according to any one of Supplementary notes 1 to 11, wherein one of the first region and the second region includes a first layer and a second layer formed of different material from the first layer, and the other of the first region and the second region includes the second layer without the first layer.

(Supplementary Note 16)

A pattern forming method using a radome, the radome being arranged to face an antenna, configured to transmit a radiation radio wave of the antenna, and comprising a first region and a second region having different radio-wave transmission characteristics from each other, the method comprising:

superimposing a first radio wave that has passed through the first region and a second radio wave that has passed through the second region to form a null pattern in substantially a front direction of the antenna.

REFERENCE SIGNS LIST

1 Antenna device
10 Antenna main body
20, 30, 40, 50, 60, 70, 80, 90 Radome
20A, 30A, 40A, 50A, 60A, 70A, 80A, 90A First region
20B, 30B, 40B, 50B, 60B, 70B, 80B, 90B Second region
21A, 31A, 61A, 71A, 81A, 93A, 94A First layer
21B, 31B, 61B, 71B, 81B, 93B, 94B Second layer
51A, 51B, 52A, 52B, 91A, 91B, 92A, 92B Partial region

The invention claimed is:

1. A radome arranged to face an antenna and configured to transmit a radiation radio wave of the antenna, the radome comprising:

a first region and a second region having different radio-wave transmission characteristics from each other, wherein the radome is configured to form a null pattern in substantially a front direction of the antenna by superimposing a first radio wave that has passed through the first region and a second radio wave that has passed through the second region, the radome has a circular shape in a plane orthogonal to a direction in which the antenna faces the radome, the first region and the second region each include a plurality of partial regions, and an arrangement pattern of the partial regions included in the first region and an arrangement pattern of the partial regions included in the second region are patterns each having a rotational symmetry about a center of the circle.

2. The radome according to claim 1, wherein the null pattern is formed in substantially the front direction of the antenna by the first radio wave that has passed through the first region and the second radio wave that has passed through the second region canceling each other due to a phase and amplitude relation.

3. The radome according to claim 1, wherein each of the partial regions has a sector shape.

4. A radome arranged to face an antenna and configured to transmit a radiation radio wave of the antenna, the radome comprising:

a first region and a second region having different radio-wave transmission characteristics from each other, wherein the radome is configured to form a null pattern in substantially a front direction of the antenna by superimposing a first radio wave that has passed through the first region and a second radio wave that has passed through the second region, the radome has a quadrangular shape in a plane orthogonal to a direction in which the antenna faces the radome, the first region and the second region each have a plurality of partial regions, and an arrangement pattern of the partial regions included in the first region and an arrangement pattern of the partial regions included in the second region are patterns each having a rotational symmetry about an intersection point of diagonal lines of the quadrangle.

5. The radome according to claim 4, wherein each of the partial regions is a four-divided quadrangular region obtained by dividing the quadrangle into four parts each including one of four vertices of the quadrangle.

6. The radome according to claim 1, wherein the first region and the second region have different thicknesses from each other.

7. The radome according to claim 1, wherein the first region and the second region are formed of different materials from each other.

8. The radome according to claim 1, wherein the first region or the second region is an air layer.

9. The radome according to claim 1, wherein one of the first region and the second region includes a first layer and a second layer formed of different material from the first layer, and the other of the first region and the second region includes the second layer without the first layer.

10. A pattern forming method using a radome, the radome being arranged to face an antenna, configured to transmit a radiation radio wave of the antenna, and comprising a first region and a second region having different radio-wave transmission characteristics from each other, the method comprising:

superimposing a first radio wave that has passed through the first region and a second radio wave that has passed through the second region to form a null pattern in substantially a front direction of the antenna, wherein the radome is configured to form a null pattern in substantially a front direction of the antenna by superimposing a first radio wave that has passed through the first region and a second radio wave that has passed through the second region, the radome has a circular shape in a plane orthogonal to a direction in which the antenna faces the radome, the first region and the second region each include a plurality of partial regions, and an arrangement pattern of the partial regions included in the first region and an arrangement pattern of the partial regions included in the second region are patterns each having a rotational symmetry about a center of the circle.

* * * * *